US006935080B2

(12) United States Patent
Allwein et al.

(10) Patent No.: US 6,935,080 B2
(45) Date of Patent: Aug. 30, 2005

(54) PRE-CUT FIBROUS INSULATION FOR CUSTOM FITTING WALL CAVITIES OF DIFFERENT WIDTHS

(75) Inventors: Robert J. Allwein, Highlands Ranch, CO (US); Larry J. Weinstein, Littleton, CO (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/782,793

(22) Filed: Feb. 13, 2001

(65) Prior Publication Data

US 2004/0055227 A1 Mar. 25, 2004

(51) Int. Cl.[7] ..... E04B 1/74

(52) U.S. Cl. ..... 52/404.1; 52/407.3; 52/98; 428/43; 428/136

(58) Field of Search ..... 52/98, 100, 404.1, 52/407.3, 407.1; 428/43, 74, 124, 126, 136

(56) References Cited

U.S. PATENT DOCUMENTS

| | | | | |
|---|---|---|---|---|
| 1,238,356 A | * | 8/1917 | Stokes | 428/43 |
| 2,335,968 A | | 12/1943 | Sawtell | |
| 3,940,526 A | * | 2/1976 | Fathi | 428/117 |
| 3,958,385 A | * | 5/1976 | Bondra et al. | 52/404.1 |
| 4,397,898 A | * | 8/1983 | Ray, Jr. | 428/43 |
| 4,756,945 A | | 7/1988 | Gibb | |
| 4,866,905 A | | 9/1989 | Bihy | |
| 5,277,955 A | * | 1/1994 | Schelhorn et al. | 428/74 |
| 5,331,787 A | | 7/1994 | Paulitschke | |
| 5,545,453 A | | 8/1996 | Grant | |
| 5,567,504 A | | 10/1996 | Schakel | |
| 5,765,318 A | * | 6/1998 | Michelsen | 52/98 |
| 6,083,594 A | | 7/2000 | Weinstein | |
| 6,128,884 A | | 10/2000 | Berdan | |
| 6,165,305 A | | 12/2000 | Weinstein | |

FOREIGN PATENT DOCUMENTS

| | | |
|---|---|---|
| DE | GM 78 30 852 | 1/1979 |
| DE | 31 18597 A1 | 11/1982 |
| DE | 32 03 624 C3 | 4/1983 |
| DE | 32 29 601 C2 | 2/1984 |
| DE | 197 00 373 A1 | 2/1998 |
| DE | 298 22 362 U1 | 5/1999 |
| DE | 199 14 782 A1 | 10/2000 |

* cited by examiner

*Primary Examiner*—Brian E. Glessner
(74) *Attorney, Agent, or Firm*—Robert D. Touslee; Timothy G. Hofmeyer

(57) ABSTRACT

An elongated fibrous insulation blanket is pre-cut for custom fitting the insulation blanket into wall, floor, ceiling and roof cavities of different widths formed by the framework of a building. The blanket has one or more cuts extending for the length of the blanket which separate the blanket into two or more longitudinally extending sections. Adjacent sections of the blanket are joined together along the cut(s) by separable adhesive connectors which hold together the sections of the blanket for handling, but are separable by hand along the cut(s) so that the blanket can be handled as a unit for insulating a cavity having a predetermined width or easily separated by hand into two or more sections at a cut for insulating a cavity having a lesser width. The pre-cut insulation blanket may have a facing sheet, overlaying and bonded to a major surface of the blanket, that is separable by hand along the cut(s).

24 Claims, 6 Drawing Sheets

FIG. 43
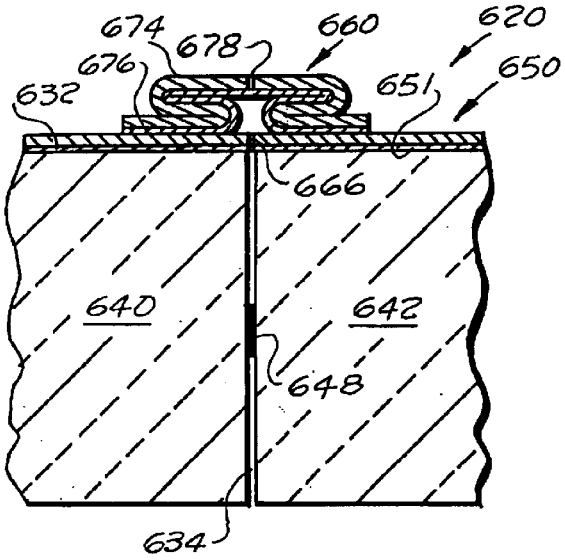
FIG. 46
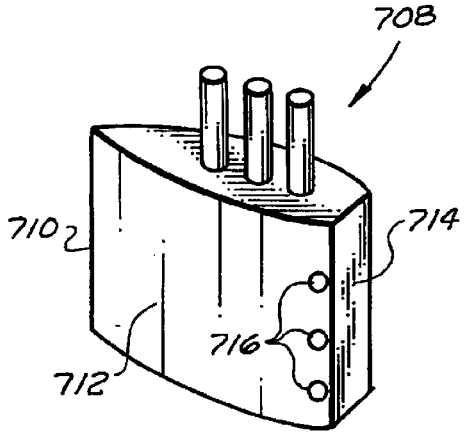
FIG. 44
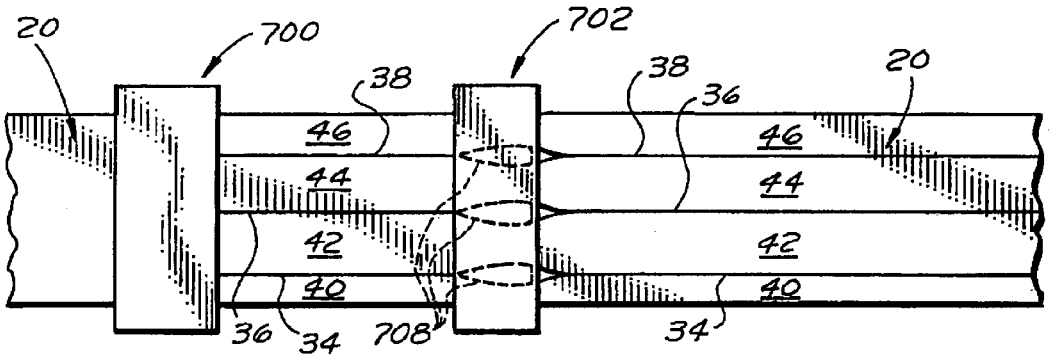
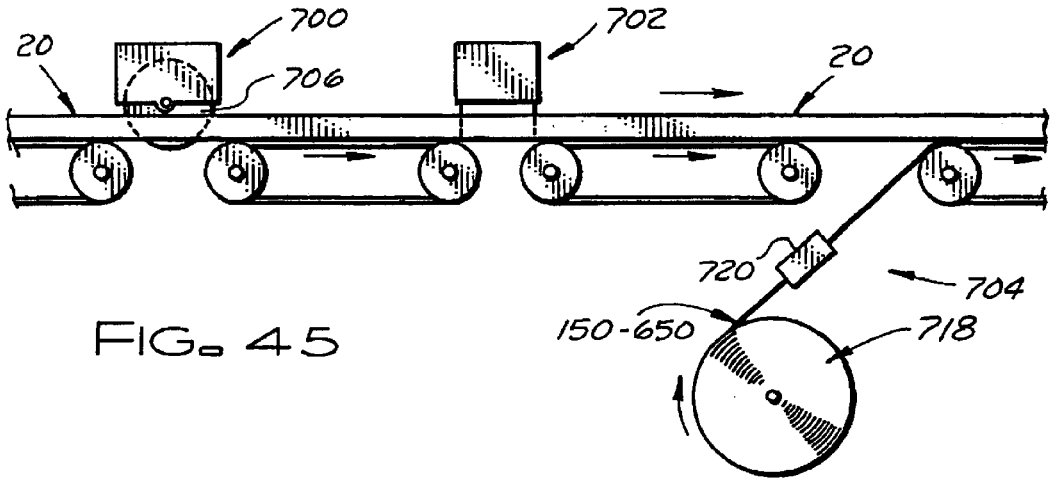
FIG. 45

PRE-CUT FIBROUS INSULATION FOR CUSTOM FITTING WALL CAVITIES OF DIFFERENT WIDTHS

BACKGROUND OF THE INVENTION

The present invention relates to a fibrous insulation blanket pre-cut for custom fitting the fibrous insulation blanket into cavities of different widths formed by the framework of a building, such as both standard and non-standard width wall, floor, ceiling or roof cavities formed in part by successive frame members; and, in particular, to a pre-cut fibrous insulation blanket with sections, held together by separable adhesive connectors, that can be handled as a unit when insulating a cavity of a certain predetermined width or easily separated or torn apart (by hand) along one or more cuts formed in the fibrous insulation blanket to form narrower blankets when insulating a cavity having a lesser width.

Building structures, such as residential houses, industrial buildings, office buildings, mobile homes, prefabricated buildings and similar structures typically include walls (both interior and exterior), ceilings, floors and roofs which are insulated for both thermal and acoustical purposes, especially the exterior walls, the ceilings below open attic spaces, and the roofs of such structures. The walls, ceilings, floors and roofs of these structures include framing members, e.g. studs, rafters, floor and ceiling joists, beams and similar support members, which are normally spaced-apart standard distances established by the building industry. Sheathing, paneling, lathing or similar construction materials are secured to these framing members to form the walls, ceilings, floors and roofs of the structures. While the contractor seeks to maintain the spacing of such framing members in these structures at these standard distances for ease of construction and the insulation of the elongated cavities formed in these walls, ceilings, floors, and roofs, frequently, the walls, ceilings, floors and/or roofs of these structures include elongated cavities defined, at least in part, by successive or adjacent framing members which are spaced apart a nonstandard distance less than the standard spacing between framing members. Studies have shown that in a typical residential house, it is common for 50% or more of the framing members in the exterior walls of these structures to be spaced apart at nonstandard distances less than the standard spacing for such framing members.

When insulating these elongated cavities of various nonstandard widths, less than a standard width, it has been the practice to take an insulation batt preformed to fit the standard cavity width and reduce the width of the insulation batt by cutting off and removing a strip of insulation material from one or both longitudinal edges of the insulation batt. U.S. Pat. No. 5,331,787; issued Jul. 26, 1994; to Kaarst; illustrates this approach. In the invention of this patent, the insulation batts or panels have widths at least equal to a predetermined maximum distance between adjacent support members defining the cavities that the batts or panels are to insulate. The batts or panels are provided with facings that are folded over along the longitudinal edges of the batts or panels so that strips of insulation material can be cut away from one or both longitudinal edges of the batts or panels to fit the batts or panels between support members spaced apart less than the predetermined maximum spacing. This method of trimming the insulation batts at the job site by cutting the batts to fit between the more closely spaced support members is time consuming, raises a significant risk or safety issue, relies heavily on the worker's skill to accurately trim the batt or panel.

U.S. Pat. No. 4,866,905; issued Sep. 19, 1989; to Bihy et al; discloses another approach to the problem. In the invention disclosed in this patent, a continuous strip of fibrous insulation with transverse marking lines is provided. The worker cuts the strip of fibrous insulation at the job site to a width somewhat greater than the spacing between the framing members, i.e. rafters, defining the space to be insulated. Of course this method of forming insulation batts or panels at the job site is also time consuming and relies heavily on the skill of the worker cutting the insulation strip to achieve a good result.

A different approach to the problem is shown in U.S. Pat. No. 2,335,968; issued Dec. 7, 1943; to Sawtell. In the invention of this patent, the lateral edges of the insulation blanket are turned down to enable the insulation batt to be placed between framing members, i.e. rafters, spaced closer together than the width of the insulation batt. This approach does not require any cutting or trimming at the job site, but it can only be used where the spacing between the framing members is slightly less than the width of insulation blanket. In addition, the extra insulation material used to insulate cavities having less than a standard cavity width would add significantly to material costs.

Thus it can be seen that there has been a need to provide fibrous insulation blankets or batts which can be used to either insulate cavities of a predetermined width, such as but not limited to standard width framework cavities, or be quickly and easily reduced in width to fit cavities of lesser widths, such as less than standard width cavities, without a need to cut the fibrous insulation blankets at the job site with knives or similar cutting tools which is both time consuming and can result in cuts or other injuries to the workers.

SUMMARY OF THE INVENTION

The pre-cut fibrous insulation blanket of the present invention provides a solution to the above discussed problems. The pre-cut fibrous insulation blanket of the present invention is pre-cut for custom fitting the insulation blanket into building cavities of different widths formed by the framework of a building. The width of the pre-cut fibrous insulation blanket is normally equal to or substantially equal to the width of a standard cavity to be insulated by the pre-cut fibrous insulation blanket, e.g. about fourteen and one half to about fifteen inches or about twenty two and one half to about twenty three inches in width for a typical wall cavity. However, the pre-cut fibrous insulation blanket may also be initially formed at a selected width, e.g. about thirteen to about thirteen and one half inches, less than a standard cavity width.

Do to the compressibility and resilience of the pre-cut fibrous insulation blankets of the present invention (generally pre-cut glass fiber insulation blankets), the pre-cut fibrous insulation blankets can be fitted into cavities having a width up to about one and one half to two inches less than the width of the pre-cut fibrous insulation blankets without removing any sections of the blankets, e.g. a pre-cut fibrous insulation blanket having a width between about fourteen and one half to about fifteen inches can be installed within a cavity having a width of about twelve and one half to about thirteen inches or greater. For cavities of lesser widths, greater than about one and one half to two inches less in width than the pre-cut fibrous insulation blankets, the pre-cut fibrous insulation blankets may have one or more sections removed from the blankets so that the remaining portions of the pre-cut fibrous insulation blankets will better fit into the cavities being insulated.

The unfaced and faced pre-cut fibrous insulation blankets of the present invention each have at least one (preferably, two or more) cuts extending between a first major surface to a second major surface of the pre-cut fibrous insulation blanket. Each cut extends for the length of the pre-cut fibrous insulation blanket and is spaced inwardly from the lateral edges of the insulation blanket and laterally from any other cut in the pre-cut fibrous insulation blanket. The cut(s) separate the pre-cut fibrous insulation blanket into a plurality of longitudinally extending sections separated by the cut(s). Separable adhesive connectors hold together adjacent sections of the pre-cut fibrous insulation blanket for handling, but are separable by hand along the length of each cut whereby the pre-cut fibrous insulation blanket can be handled as a unit for insulating a cavity having a predetermined width, such as but not limited to a standard cavity width, or easily separated by hand into two or more sections at each cut and separable adhesive connector(s) for insulating a cavity of lesser width, such as a cavity having less than a standard width.

Preferably, the separable adhesive connectors are continuous or discontinuous strips or layers of adhesive intermediate and extending along the length of adjacent blanket sections which bond the opposed surfaces of adjacent blanket sections together for handling. These adhesive strips or layers are separable by hand along the cuts between the blanket sections (portions of the adhesive strips or layers are separable from each other) and/or are separable by hand from one or both of the opposed surfaces of the blanket sections along the cuts intermediate the blanket sections so that one or more blanket sections can be separated from the remainder of the pre-cut fibrous insulation blanket. The blanket section or sections separated from the remainder of the pre-cut fibrous insulation blanket are then installed in a wall, floor, ceiling or roof cavity to insulate the cavity or the remainder of the blanket, now less in width, is then installed in a wall, floor, ceiling or roof cavity to insulate the cavity.

When the pre-cut fibrous insulation blanket includes a facing sheet, the facing sheet of the pre-cut fibrous insulation blanket, preferably, has one or more perforated lines or overlapping tabs (tabs which are adhesively bonded together), and/or tear strings for permitting the facing to be separated at each cut in the pre-cut fibrous insulation blanket to facilitate separating or tearing apart the faced pre-cut insulation blanket by hand, if required. Preferably, the perforations of the perforated line(s) in the facing sheet are closed by the adhesive or bonding agent bonding the facing sheet to the pre-cut fibrous insulation blanket. The filling of the perforations in the facing sheet with the bonding agent helps to reinforce or increase the integrity of the facing sheet at the perforations to prevent an unwanted separation of the facing sheet at the perforations and enables the facing sheet to function as a vapor barrier in spite of the perforations. Thus, the pre-cut fibrous insulation blanket with the facing sheet can still be quickly and easily modified to fit a cavity of a particular width without sacrificing the vapor barrier properties of the facing sheet.

Preferably, the facing sheet has tabs for securing the faced pre-cut fibrous insulation blanket to framing members, e.g. with mechanical fasteners such as staples or with an adhesive. These tabs may be located along each lateral edge of the pre-cut fibrous insulation blanket and facing sheet and pairs of tabs may be located adjacent each cut in the pre-cut fibrous insulation blanket with the perforated lines in the facing sheet or an adhesive layer separably joining the tabs of each pair of tabs.

With the faced or unfaced pre-cut fibrous insulation blanket of the present invention, the pre-cut fibrous insulation blanket can be quickly and easily sized to fit wall, floor, ceiling, roof and other building cavities formed by the framework of a building without the need to use cutting tools at the job site to cut the insulation. Thus, the use of the pre-cut fibrous insulation blanket of the present invention to insulate the wall, floor, ceiling and roof cavities of buildings, especially wall cavities, not only reduces safety concerns, but greatly speeds up the installation process. Since insulation installers are frequently paid by the piece, the present invention enables them to operate more profitably.

BRIEF DESCRIPTION OF THE DRAWINGS

FIG. 43 is a partial schematic transverse cross section of the faced pre-cut fibrous insulation blanket of the present invention showing a separable adhesive connector joining adjacent blanket sections and a facing sheet with tabs, formed by double Z-pleats in a separate sheet of facing material, bonded to a major surface of the blanket and separable along the cut in the blanket.

FIG. 44 is a schematic plan view of a production line for making the unfaced and faced pre-cut fibrous insulation blanket of the present invention.

FIG. 45 is a schematic side view of a production line for making the unfaced and faced pre-cut fibrous insulation blanket of the present invention.

FIG. 46 is a schematic perspective view of an adhesive applicator for applying separable adhesive connectors between opposing surfaces of adjacent blanket sections of the pre-cut fibrous insulation blanket of the present invention.

DESCRIPTION OF THE PREFERRED EMBODIMENTS

Figure 1:
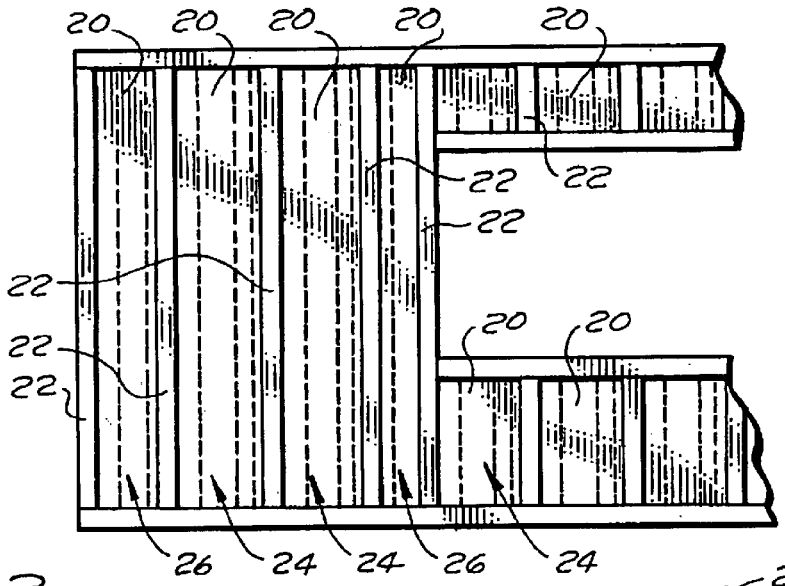
FIG. 1 is a schematic elevation of the framework in an outside wall of a building with pre-cut fibrous insulation blankets of the present invention installed in standard width and less than standard width wall cavities defined by the frame members.
Figure 2:
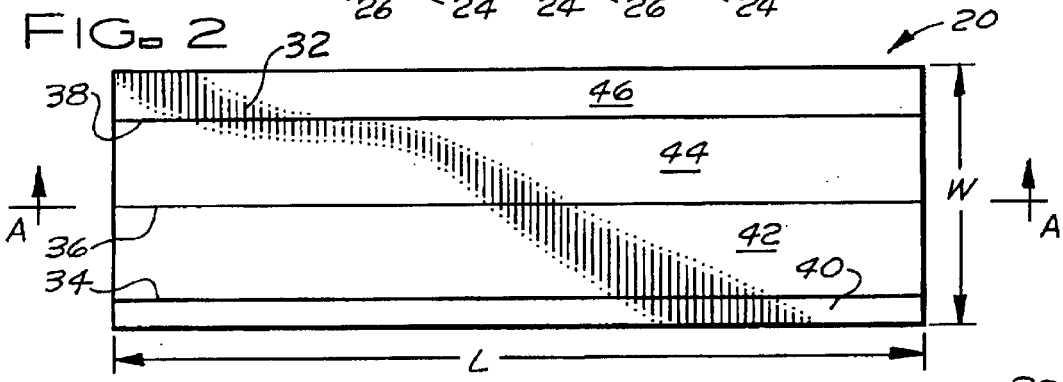
FIG. 2 is a schematic view of a major surface of an unfaced pre-cut fibrous insulation blanket of the present invention with three cuts in the fibrous insulation blanket.

FIG. 1 shows a portion of a typical outside wall of a residential house with an unfaced, pre-cut, four section, fibrous insulation blanket 20 of the present invention installed in both standard width and non-standard width wall cavities of the outside wall. The cuts in the pre-cut fibrous insulation blanket 20 which separate the pre-cut fibrous insulation blanket into different sections are represented by dashed lines. The widths of the wall cavities are defined by the framing members 22 (e.g. 2×4, 2×6 or 2×10 wall studs) which are spaced apart a standard distance (e.g. spaced apart on sixteen or twenty four inch centers) for standard width cavities 24 and less than the standard distance for non-standard width cavities 26.

While the unfaced and faced pre-cut fibrous insulation blankets of the present invention may be made of other fibrous materials, preferably the unfaced and faced pre-cut fibrous insulation blankets of the present invention are made of glass fibers and typically have a density between about 0.4 pounds/ft$^3$ and about 1.5 pounds/ft$^3$. Examples of other fibers that may be used to form the unfaced and faced pre-cut fibrous insulation blankets of the present invention are mineral fibers, such as but not limited to, rock wool fibers, slag fibers, and basalt fibers, and organic fibers such as but not limited to polypropylene, polyester and other polymeric fibers. The fibers in the unfaced and faced pre-cut fibrous insulation blankets of the present invention may be bonded together for increased integrity, e.g. by a binder at their points of intersection such as but not limited to urea phenol formaldehyde or other suitable bonding materials, or the unfaced and faced pre-cut fibrous insulation blankets of the present invention may be binderless provided the blankets possess the required integrity.

Preferably, the unfaced and faced pre-cut fibrous insulation blankets of the present invention are resilient so that, after being compressed to insert the pre-cut fibrous insulation blanket or section(s) of the pre-cut fibrous insulation blanket into a cavity having a width somewhat less than the width of the pre-cut fibrous insulation blanket or the section (s) of the pre-cut fibrous insulation blanket being inserted into the cavity, the pre-cut fibrous insulation blanket or one or more sections of the pre-cut fibrous insulation blanket inserted into the cavity will expand to the width of the cavity and press against the sides of the cavity to hold or help hold the pre-cut fibrous insulation blanket or section(s) of the pre-cut fibrous insulation blanket in place.

Typically, for most applications, such as walls in residential houses, the resilient, unfaced and faced pre-cut fibrous insulation blankets of the present invention are delivered to the installer in the form of batts about forty six to about forty eight inches long or about ninety three inches long or in the form of rolls of various lengths greater than ninety three inches in length. Typically, the widths of the unfaced and faced pre-cut fibrous insulation blankets of the present invention are substantially equal to or equal to the standard cavity width to be insulated with the pre-cut fibrous insulation blankets, e.g. about fourteen and one half to about fifteen inches wide for a cavity where the standard center to center spacing of the wall, floor, ceiling or roof framing members is sixteen inches (the cavity has a width of about fourteen and one half inches) and about twenty two and one half to about twenty three inches wide for a cavity where the standard center to center spacing of the wall, floor, ceiling or roof framing members is twenty four inches (the cavity has a width of about twenty two and one half inches). However for certain applications, the pre-cut fibrous insulation blanket may have a different initial width, such as but not limited to about thirteen to about thirteen and one half inches.

The following examples illustrate how the faced or unfaced pre-cut fibrous insulation blanket of the present invention may be formed into sections. For a faced or unfaced pre-cut fibrous insulation blanket having a width of about fifteen inches which is divided into three sections, the sections may be about three and one-half, about five, and about six and one-half inches wide (from right to left or left to right). For a faced or unfaced pre-cut fibrous insulation blanket having a width of about fifteen inches which is divided into four sections, preferably, the sections are about two and one half, about four, about four, and about four and one half inches wide (from left to right or right to left). Another example of section widths for a pre-cut fibrous insulation blanket about fifteen inches wide is about three and one-half, about four and one-half, about five and one-half, and about one and one-half inches wide (from right to left or left to right). For a faced or unfaced pre-cut fibrous insulation blanket having a width of about twenty three inches which is divided into four sections, preferably, the sections are about eleven and one half, about four, about four, and about three and one half inches wide (from left to right or right to left). For a faced or unfaced pre-cut fibrous insulation blanket having a width of about twenty three inches which is divided into six sections, preferably, the sections are about three, about four, about four, about three, about four and about five inches wide (from left to right or right to left). For a faced or unfaced pre-cut fibrous insulation blanket about thirteen inches in width which is divided into three sections, the sections may be about three, about four and one half and about five and one half inches wide.

Note that the preferred slit configurations for the fifteen inch and twenty three inch wide pre-cut fibrous insulation blankets are designed to provide blanket pieces in widths that for the most part differ in roughly two inch increments. For example with the preferred 2½ inch, 4 inch, 4 inch and 4½ inch wide section configuration of a fifteen inch wide pre-cut fibrous insulation blanket, with one tear of the unfaced or faced pre-cut fibrous insulation blanket, a blanket 2½ inches, 4½ inches, 6½ inches, 8½ inches, 10½ inches or 12½ inches in width can be formed to fit a cavity of a particular width less than a standard cavity width. For example with the preferred 3 inch, 4 inch, 4 inch, 3 inch, 4 inch, and 5 inch wide section configuration of a twenty three inch wide pre-cut fibrous insulation blanket, with one tear of the unfaced or faced pre-cut fibrous insulation blanket, a blanket 3 inches, 5 inches, 7 inches, 9 inches, 11 inches, 12 inches, 14 inches, 15 inches, 18 inches, or 20 inches in width can be formed to fit a cavity of a particular width less than a standard cavity width. Insulation installers generally custom cut insulation blankets to be about 1 inch to about 1½ inches wider than the cavity being insulated and the blanket widths formed above essentially permit cavities of all widths to be insulated with a piece of insulation blanket about ½ of an inch to about 2 inches wider than the cavity being insulated without over compressing the insulation in the direction of its width. In both the fifteen inch and twenty three inch wide pre-cut fibrous insulation blankets, the ability to form blanket pieces which generally differ in width in about two inch increments was accomplished by making the two outer most sections two inches different in width and then making the inner sections, except for one of the central sections of the twenty three inch wide blanket about four inches in width.

The thicknesses of the unfaced and faced pre-cut fibrous insulation blankets of the present invention are determined by the amount of thermal resistance or sound control desired and the depth of the cavities being insulated. Typically, the pre-cut fibrous insulation blanket is about three to about ten inches or greater in thickness and approximates the depth of the cavity being insulated. For example, in a wall cavity defined in part by nominally 2×4 or 2×6 inch studs or framing members, a pre-cut fibrous insulation blanket will have a thickness of about three and one-half inches or about five and one-quarter inches, respectively.

The adhesives, the coatings of glue, mastics or other sticky substances or bonding agents, forming separable adhesive connectors for the pre-cut fibrous insulation blankets of the present invention include: asphalt; hot melt adhesives; water based adhesives; and solvent based adhesives. Example of hot melt adhesives are adhesives sold by Heartland Adhesives and Coatings under the trade designation H167 and H300-A7. An example of a water based adhesive is an adhesive sold by Mon-Eco Industries under the trade designation DLM 22–68. An example of a solvent based adhesive is an adhesive sold by Mon-Eco Industries under the trade designation 22–42 HVAC. The separation of the separable adhesive connector or connectors to separate or detach adjacent blanket sections from each other may take place within the adhesive strip(s), layer(s) or coating(s) themselves or between the adhesive strip(s), layer(s) or coating(s) and either or both opposing surfaces of the adjacent blanket sections joined by the adhesive strip(s), layer(s) or coating(s).

Preferably, the facings or facing sheets of the faced pre-cut fibrous insulation blankets of the present invention are impermeable to water vapor; are made of kraft paper, a foil-scrim-kraft paper laminate, a polymeric film, such as but not limited to polyethylene, or another facing material commonly used in the building insulation industry; and are bonded to a major surface of the pre-cut fibrous insulation blanket by an adhesive or bonding agent. Preferably, the bonding agent for kraft paper or foil-scrim-kraft paper facings is an asphalt or other bituminous material that can be coated onto or otherwise applied to one side of the facing sheet just prior to applying the facing sheet to the pre-cut fibrous insulation blanket and the bonding agent for the polymeric film facing is a commercially available pressure sensitive adhesive that can be coated onto or otherwise applied to one side of the facing sheet just prior to applying the facing sheet to the pre-cut fibrous insulation blanket.

FIGS. 2 to 23 show unfaced, four section, embodiments 20 of the pre-cut fibrous insulation blanket of the present invention. The pre-cut fibrous insulation blankets 20 have a length "L", a width "W" and a thickness "T". First major surfaces 30 and second major surfaces 32 of the pre-cut fibrous insulation blankets 20 are each defined by the width "W" and length "L" of the insulation blankets. There are one or more cuts, preferably two, three or more cuts (three cuts 34, 36 and 38 are shown) which each extend from the first major surface to the second major surface of each of the pre-cut fibrous insulation blankets and for the length of each of the pre-cut fibrous insulation blankets 20. Each cut in a pre-cut fibrous insulation blanket 20 divides the pre-cut fibrous insulation blanket 20 into blanket sections with the pre-cut fibrous insulation blanket being divided lengthwise into two or more blanket sections and, preferably, three, four or more blanket sections (four blanket sections 40, 42, 44 and 46 are shown) extending the length of the pre-cut fibrous insulation blanket.

The separable adhesive connectors 48, which join the adjacent sections 40, 42, 44 and 46 of the pre-cut fibrous insulation blankets, extend for the lengths the pre-cut fibrous insulation blankets. The adhesive or bonding agent forming the separable adhesive connectors 48 between adjacent blanket sections of the pre-cut fibrous insulation blankets 20 may applied between the opposed surfaces of adjacent blanket sections 40, 42, 44 and 46 in the form of discontinuous or continuous adhesive strips or beads, typically about one eighth of an inch to about one or one and one half inches in width, or in the form of discontinuous or continuous adhesive layers which typically extend from the first major surface to the second major surface or, substantially, from the first major surface to the second major surface of the precut fibrous insulation blanket 20. In addition to the discontinuous and continuous adhesive strips and layers forming the separable adhesive connectors 48, shown in this application, the adhesive forming the separable adhesive connectors 48 may be applied between the opposed surfaces of adjacent blanket sections by coating or spraying the adhesive in various random or patterned forms that do not completely cover the opposed surfaces of the adjacent blanket sections to reduce the amount of adhesive used in the connectors 48. With the separable connectors 48 joining the adjacent blanket sections 40, 42, 44 and 46 of the pre-cut fibrous insulation blankets 20 together, the pre-cut fibrous insulation blankets 20 can be handled as a unit for insulating a cavity having a predetermined width, such as but not limited to a thirteen inch width or a fourteen and one half or twenty two and one half standard cavity width, or easily separated by hand at one or more of the cuts 34, 36 and/or 38 by separating or tearing apart the separable adhesive connectors 48 along the cuts (separated without the need to use of a knife or other cutting tool) into one or more sections 40, 42, 44 and/or 46 for insulating a cavity having a lesser width, such as less than a standard cavity width.

FIGS. 3 to 23 show a number of examples of separable adhesive connectors 48 that may be used to separably join adjacent blanket sections of the unfaced pre-cut fibrous insulation blanket 20 and the faced pre-cut fibrous insulation blankets 120 to 620 of the present invention.

Figure 3:
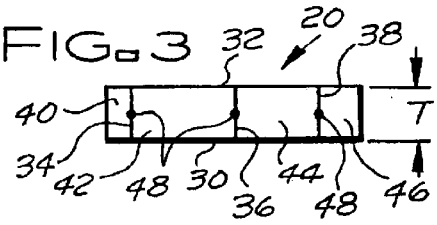
FIGS. 3, 6, 9, 12, 15, 18 and 21 are schematic end views of the pre-cut fibrous insulation blanket of FIG. 2 illustrating different forms of separable adhesive connectors joining adjacent blanket sections of the pre-cut fibrous insulation blanket.
Figure 4:
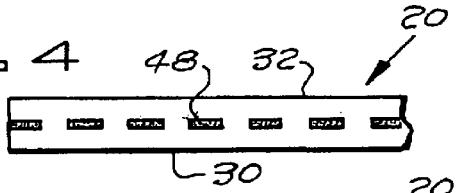
FIGS. 4 and 5, 7 and 8, 10 and 11, 13 and 14, 16 and 17, 19 and 20, and 22 and 23 are schematic views of the pre-cut fibrous insulation blanket of FIG. 2, taken substantially along lines A—A of FIG. 2 which coincide with a longitudinal cut between blanket sections, and illustrating different forms of separable adhesive connectors joining adjacent blanket sections of the pre-cut fibrous insulation blanket.
Figure 5:
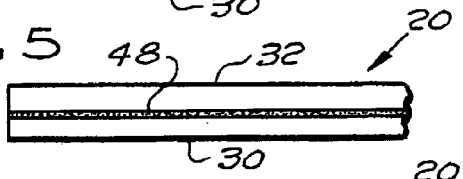

FIGS. 3, 4 and 5 show a separable adhesive connector 48 intermediate and joining each pair of adjacent sections 40, 42, 44 and 46 of the pre-cut fibrous insulation blanket 20. As shown, the separable adhesive connector 48, joining each pair of adjacent sections of the pre-cut fibrous insulation blanket 20, is a single adhesive strip or bead located about midway between and, preferably, midway between the major surfaces 30 and 32 of the pre-cut fibrous insulation blanket 20. Each adhesive strip or bead extends for the length of the pre-cut fibrous insulation blanket 20 and may be discontinuous as shown in FIG. 4 or continuous as shown in FIG. 5.

Figure 6:
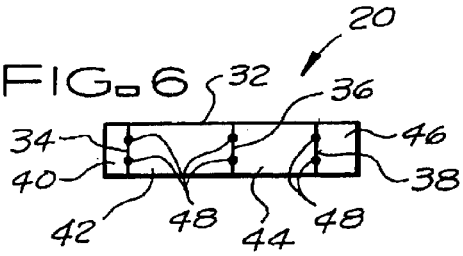
Figure 7:
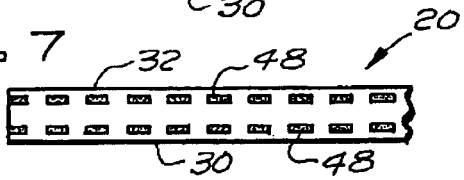
Figure 8:
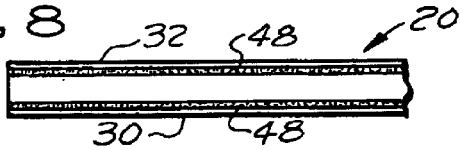

FIGS. 6, 7 and 8 show two separable adhesive connectors 48 intermediate and joining each pair of adjacent sections 40, 42, 44 and 46 of the pre-cut fibrous insulation blanket 20. As shown, the separable adhesive connectors 48, joining each pair of adjacent sections of the pre-cut fibrous insulation blanket 20, are adhesive strips or beads with one adhesive strip or bead typically being located about one third of the blanket thickness inward from the first major surface 30 and the other adhesive strip or bead typically being located about one third of the blanket thickness inward from the second major surface 32 of the pre-cut fibrous insulation blanket 20. Each adhesive strip or bead extends for the length of the pre-cut fibrous insulation blanket 20 and may be discontinuous as shown in FIG. 7 or continuous as shown in FIG. 8.

Figure 9:
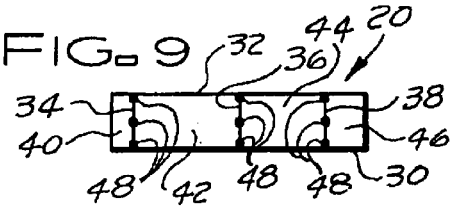
Figure 10:
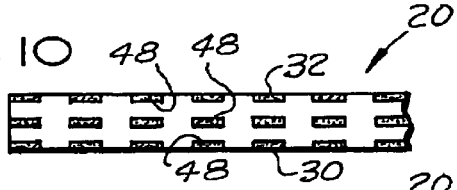
Figure 11:
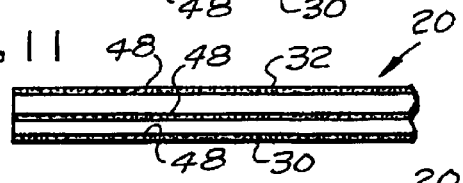

FIGS. 9, 10 and 11 show three separable adhesive connectors 48 intermediate and joining each pair of adjacent sections 40, 42, 44 and 46 of the pre-cut fibrous insulation blanket 20. As shown, the separable adhesive connectors 48, joining each pair of adjacent sections of the pre-cut fibrous insulation blanket 20, are adhesive strips or beads with a first adhesive strip or bead typically being located at or adjacent but inward from the first major surface 30 of the pre-cut fibrous insulation blanket, a second adhesive strip or bead being located about midway between the first and second major surfaces 30 and 32 of the pre-cut fibrous insulation blanket, and the third adhesive strip or bead typically being located at or adjacent but inward from the second major surface 32 of the pre-cut fibrous insulation blanket. Each adhesive strip or bead extends for the length of the pre-cut fibrous insulation blanket 20 and may be discontinuous as shown in FIG. 10 or continuous as shown in FIG. 11. While three separable adhesive connectors 48 are shown intermediate each pair of adjacent blanket sections in FIGS. 9, 10 and 11, for certain applications, one or more, e.g. the middle connector, may be omitted.

Figure 12:
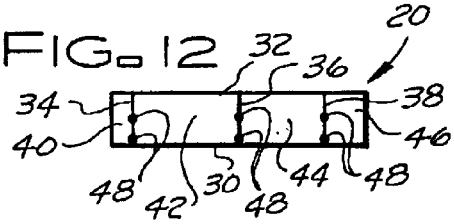
Figure 13:
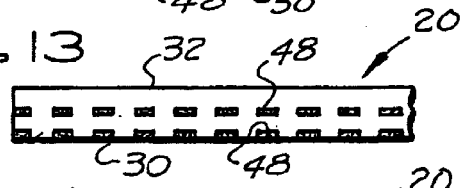
Figure 14:
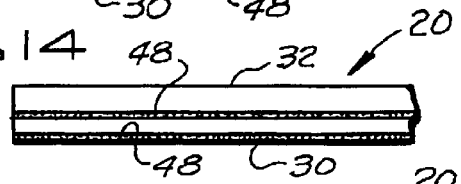

FIGS. 12, 13 and 14 show two separable adhesive connectors 48 intermediate and joining each pair of adjacent sections 40, 42, 44 and 46 of the pre-cut fibrous insulation blanket 20. As shown, the separable adhesive connectors 48, joining each pair of adjacent sections of the pre-cut fibrous insulation blanket 20, are adhesive strips or beads with one adhesive strip or bead typically being located at or adjacent but inward from the first major surface 30 of the pre-cut fibrous insulation blanket and the other adhesive strip or bead being located about midway between the first and second major surfaces 30 and 32 of the pre-cut fibrous insulation blanket or closer to the second major surface 32 than the first major surface of the pre-cut fibrous insulation blanket Each adhesive strip or bead extends for the length of the pre-cut fibrous insulation blanket 20 and may be discontinuous as shown in FIG. 13 or continuous as shown in FIG. 14.

Figure 15:
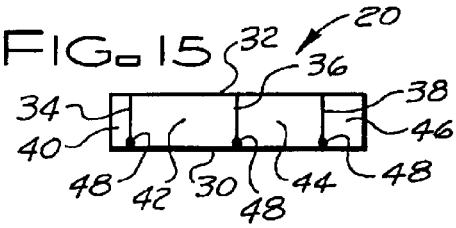
Figure 16:
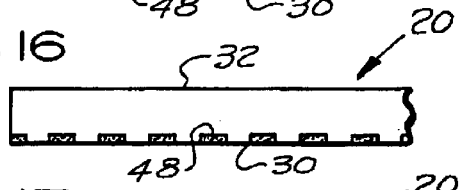
Figure 17:
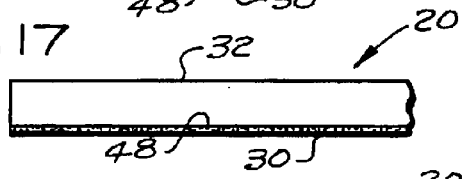

FIGS. 15, 16 and 17 show one separable adhesive connector 48 intermediate and joining each pair of adjacent sections 40, 42, 44 and 46 of the pre-cut fibrous insulation blanket 20. As shown, the separable adhesive connector 48, joining each pair of adjacent sections of the pre-cut fibrous insulation blanket 20, is adhesive strips or bead typically located at or adjacent but inward from the first major surface 30 of the pre-cut fibrous insulation blanket. Each adhesive strip or bead extends for the length of the pre-cut fibrous insulation blanket 20 and may be discontinuous as shown in FIG. 16 or continuous as shown in FIG. 17.

Figure 18:
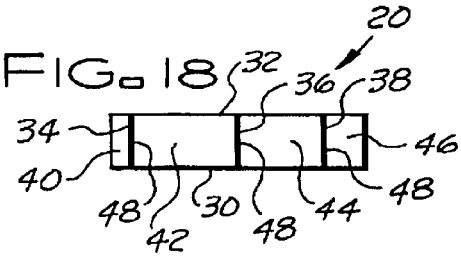
Figure 19:
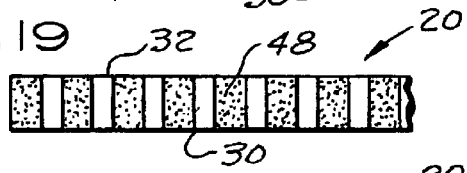
Figure 20:
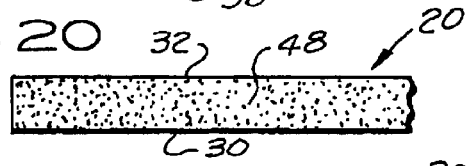

FIGS. 18, 19 and 20 show a separable adhesive connector 48 intermediate and joining each pair of adjacent sections 40, 42, 44 and 46 of the pre-cut fibrous insulation blanket 20. As shown, the separable adhesive connector 48, joining each pair of adjacent sections of the pre-cut fibrous insulation blanket 20, is an adhesive strip which typically extends from or substantially from the first major surface 30 to the second major surface 32 of the pre-cut fibrous insulation blanket. Each adhesive strip extends for the length of the pre-cut fibrous insulation blanket 20 and may be discontinuous as shown in FIG. 19 or continuous as shown in FIG. 20. In addition, the adhesive strips may be solid or patterned to reduce the amount of adhesive used to form the separable adhesive connectors 48.

Figure 21:
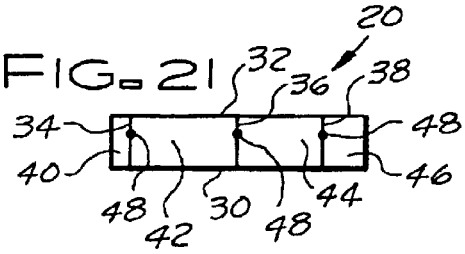
Figure 22:
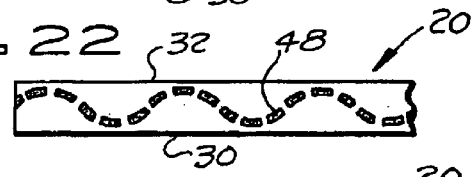
Figure 23:
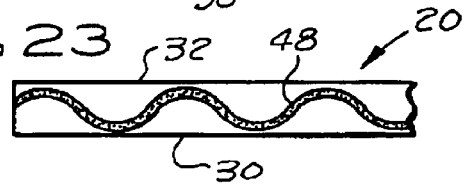

FIGS. 21, 22 and 23 show a separable adhesive connector 48 intermediate and joining each pair of adjacent sections 40, 42, 44 and 46 of the pre-cut fibrous insulation blanket 20. As shown, the separable adhesive connector 48, joining each pair of adjacent blanket sections of the pre-cut fibrous insulation blanket 20, is a single sinuous adhesive strip or bead located between opposed surfaces of adjacent blanket sections of the pre-cut fibrous insulation blanket 20. Each sinuous adhesive strip or bead extends for the length of the pre-cut fibrous insulation blanket 20 and may be discontinuous as shown in FIG. 22 or continuous as shown in FIG. 23.

While only one sinuous adhesive strip or bead is shown, two or more sinuous adhesive strips or beads could also be used to form the connectors 48 between each pair of adjacent blanket sections.

FIGS. 24 to 31 show a number of faced pre-cut fibrous insulation blankets 120 of the present invention. As with the unfaced pre-cut fibrous insulation blanket 20, there are one or more cuts, preferably two, three or more cuts (three cuts 134, 136 and 138 are shown) which each extend from the first major surface 130 to the second major surface 132 of the faced pre-cut fibrous insulation blanket and for the length of the faced pre-cut fibrous insulation blanket 120. Each cut divides the faced pre-cut fibrous insulation blanket 120 into blanket sections with the pre-cut fibrous insulation blanket being divided lengthwise into two or more blanket sections and, preferably, three, four or more blanket sections (four blanket sections 140, 142, 144 and 146 are shown) extending the length of the pre-cut fibrous insulation blanket.

Figure 24:
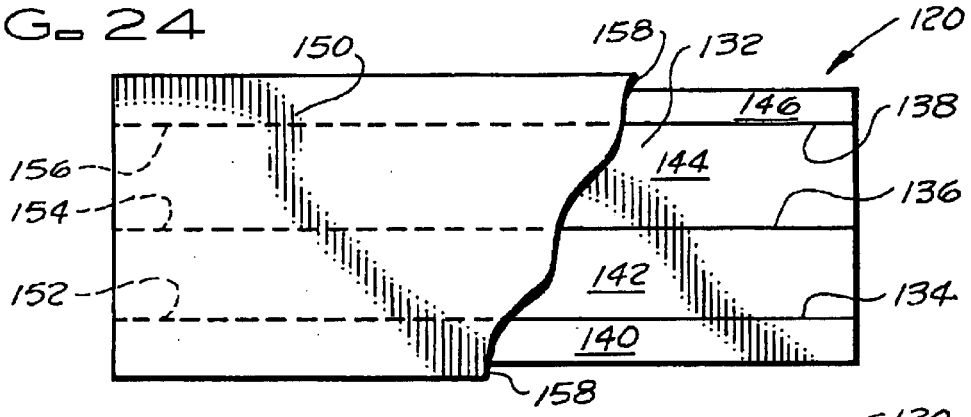
FIGS. 24 and 25 are schematic views of first and second major surfaces of a faced pre-cut fibrous insulation blanket of the present invention with a facing sheet, that has perforated lines aligned with cuts in the blanket, overlaying the second major surface of the blanket.
Figure 25:
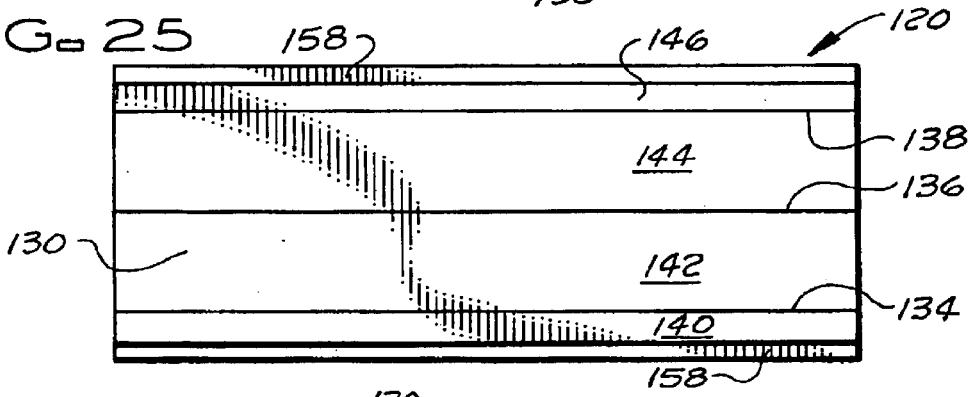
Figure 26:
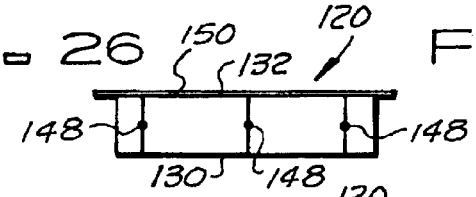
FIGS. 26 to 31 are schematic end views of the pre-cut fibrous insulation blanket of FIGS. 24 and 25 illustrating different forms of separable adhesive connectors joining adjacent blanket sections of the pre-cut fibrous insulation blanket.
Figure 27:
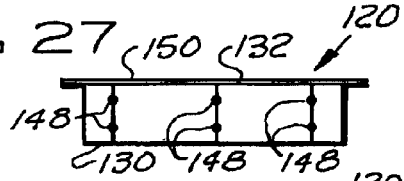
Figure 28:
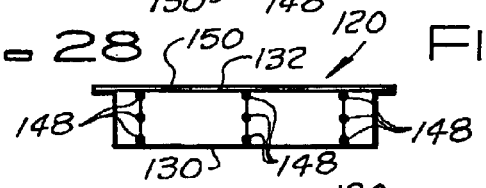

FIGS. 24 and 25 are plan views of the first, unfaced, major surface 130 of the faced pre-cut fibrous insulation blanket 120 and the second, faced major surface 132 of faced pre-cut fibrous insulation blanket 120 with a facing 150 applied to the second major surface of the pre-cut fibrous insulation blanket. The facing sheet 150, preferably a water vapor impermeable facing sheet, is bonded to the second major surface 132 of the pre-cut fibrous insulation blanket by an adhesive or bonding agent and a portion of the facing sheet 150 is broken away to show the second major surface 132 of the pre-cut fibrous insulation blanket 120. The facing sheet 150 has lines of weakness 152, 154 and 156 (perforated lines of weakness are shown) and/or tear strings (not shown) that enable the facing sheet 150 to be easily separated or torn apart by hand along the lengths of the cuts 134, 136 and/or 138. The bonding agent may applied between the facing sheet 150 and the major surface 132 of the pre-cut fibrous insulation blanket 120 in the form of an adhesive layer which is essentially coextensive with the major surfaces of the facing sheet 150 and the pre-cut fibrous insulation blanket 120 or in the form of continuous or dashed strips, dots, or other patterns covering less than the entire surface areas of the sheet and blanket (e.g. about 20% to a little less than 100% of the surface areas) provided the facing sheet 150 is bonded to the major surface 132 of the pre-cut fibrous insulation blanket, preferably along both sides of the each of the cuts in the blanket and along the lengths of each of the cuts in the blanket to help hold the pre-cut fibrous insulation blanket 120 together for handling. Preferably, the facing sheet 150 also includes lateral tabs 158 which extend for the length of the faced pre-cut fibrous insulation blanket 120.

FIGS. 26 to 31 are end views of the faced pre-cut fibrous insulation blanket 120 with the blanket sections 140, 142, 144 and 146 of the faced pre-cut fibrous insulation blanket 120 joined by the separable adhesive connectors 48 shown in FIGS. 3 to 23. With the separable adhesive connectors 148 joining the adjacent blanket sections 140, 142, 144 and 146 and portions of the facing sheet 150, overlaying the cuts 134, 136 and 138, forming separable connectors joining the adjacent blanket sections 140, 142, 144 and 146 of the pre-cut fibrous insulation blanket 120 together, the faced pre-cut fibrous insulation blanket 120 can be handled as a unit for insulating a cavity having a predetermined width, such as but not limited to a thirteen inch width or a fourteen and one half or twenty two and one half standard cavity width, or easily separated by hand at one or more of the cuts 134, 136 and/or 138 by separating or tearing apart the separable adhesive connectors 148 and the facing sheet 150 longitudinally along the cuts (separated without the need to use of a knife or other cutting tool) into one or more sections 140, 142, 144 and/or 146 for insulating a cavity having a lesser width, such as less than a standard cavity width.

Figure 32:
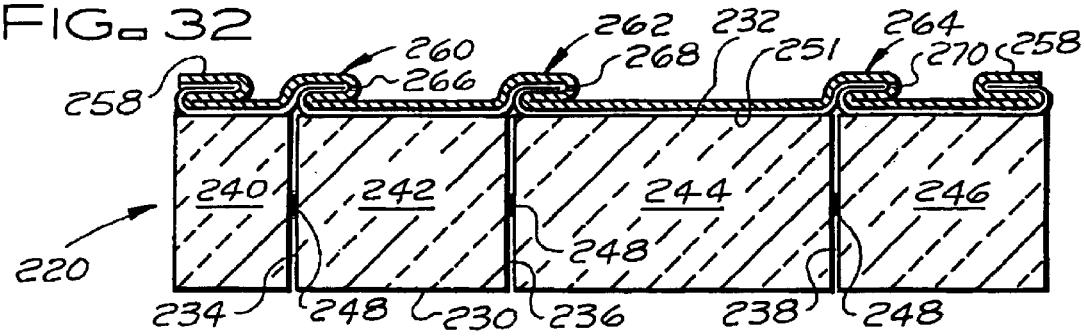
FIG. 32 is a schematic transverse cross section of a faced pre-cut fibrous insulation blanket of the present invention showing separable adhesive connectors joining adjacent blanket sections and a facing sheet with integral tabs, formed by Z-pleats, bonded to a major surface of the blanket and separable along each cut in the blanket.
Figure 33:
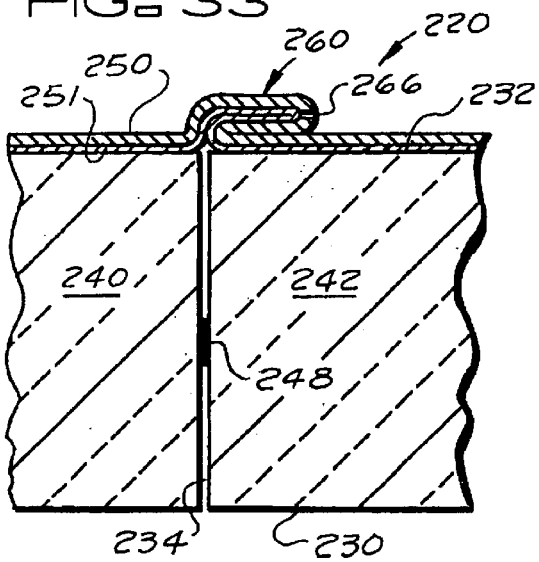
FIG. 33 is a partial schematic transverse cross section, on a larger scale than FIG. 32, of the faced pre-cut fibrous insulation blanket of FIG. 32.
Figure 34:
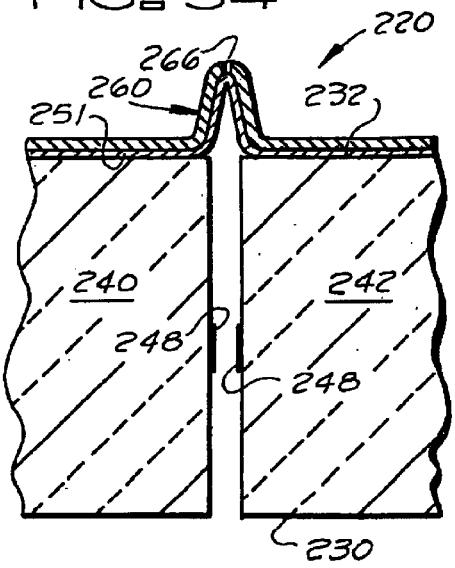
FIG. 34 is a partial schematic transverse cross section of the pre-cut fibrous insulation blanket of FIGS. 32 and 33 showing the faced pre-cut fibrous insulation blanket in the process of being separated along a cut.

FIGS. 32, 33 and 34 show an embodiment 220 of the pre-cut fibrous insulation blanket of the present invention. There are one or more cuts, preferably two, three or more cuts (three cuts 234, 236 and 238 are shown) which extend from the first major surface 230 to the second major surface 232 of the pre-cut fibrous insulation blanket and for the length of the pre-cut fibrous insulation blanket 220. Each cut divides the pre-cut fibrous insulation blanket 220 into blanket sections with the pre-cut fibrous insulation blanket being divided lengthwise into two or more blanket sections and, preferably, three, four or more blanket sections (four blanket sections 240, 242, 244 and 246 are shown) extending the length of the pre-cut fibrous insulation blanket which are separably joined by separable adhesive connectors 248.

A facing sheet 250, preferably a water vapor impermeable facing sheet, is bonded to the second major surface 232 of the pre-cut fibrous insulation blanket by a bonding agent 251. The facing sheet 252 of the pre-cut fibrous insulation blanket 220 may be easily separated or torn apart by hand along the lengths of the cuts 234, 236 and/or 238. The bonding agent may be applied between the facing sheet 252 and the major surface 232 of the pre-cut fibrous insulation blanket 220 in the form of an adhesive layer 251 which is essentially coextensive with the major surfaces of the facing sheet and the pre-cut fibrous insulation blanket or in the form of continuous or dashed strips, dots, or other patterns covering less than the entire surface areas of the sheets and blanket (e.g. about 20% to a little less than 100% of the surface areas) provided the facing sheet 250 is bonded to the major surface of the pre-cut fibrous insulation blanket, preferably along both sides of the each of the cuts in the blanket and along the lengths of each of the cuts in the blanket, to help hold the pre-cut fibrous insulation blanket 220 together for handling.

With the separable adhesive connectors 248 and portions of the facing sheet 250 overlaying the cuts 234, 236 and 238 forming separable connectors joining the adjacent blanket sections 240, 242, 244 and 246 of the pre-cut fibrous insulation blanket 220 together, the pre-cut fibrous insulation blanket 220 can be handled as a unit for insulating a cavity having a predetermined width, such as but not limited to a thirteen inch width or a fourteen and one half or twenty two and one half standard cavity width, or easily separated by hand at one or more of the cuts 234, 236 and/or 238 by separating or tearing apart the separable adhesive connectors 248 and the facing sheet 250 longitudinally along the cuts (separated without the need to use of a knife or other cutting tool) into one or more sections 240, 242, 244 and/or 246 for insulating a cavity having a lesser width, such as less than a standard cavity width.

Figure 29:
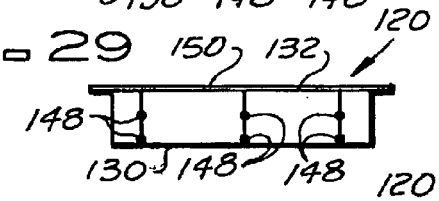
Figure 30:
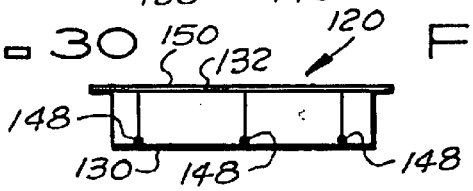
Figure 31:
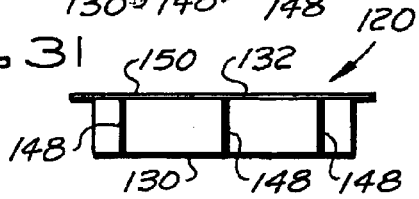

As shown in FIG. 29, the facing sheet 250 has lateral tabs 258 and pairs of tabs 260, 262 and 264 adjacent each of the cuts 234, 236 and 238 in the faced pre-cut fibrous insulation blanket 220 for stapling or otherwise securing the faced pre-cut fibrous insulation blanket or section(s) of the faced pre-cut fibrous insulation blanket to frame members. The lateral tabs 258, which preferably are formed by Z-shaped pleats in the facing 250, extend for the length of the faced pre-cut fibrous insulation blanket 220 and the pairs of tabs 260, 262 and 264 are longitudinally aligned with and extend for the lengths of the cuts 234, 236 and 238 of the faced pre-cut fibrous insulation blanket 220. Each pair of tabs 260, 262 and 264 is formed by a Z-shaped pleat in the facing sheet 250 with the tabs of each pair of tabs 260, 262 and 264 being separably connected to each other by perforated lines 266, 268 and 270, respectively so that the facing can be separated at each cut.

The spaced apart perforations of the perforated lines 266, 268 and 270 may be of various shapes, including but not limited to, round, oval, elongated, slit shaped, etc. and the spacing between perforations and the length of the perforations may vary as long as the facing is easily separated by hand along the line formed by the perforations. Preferably, the perforations of perforated lines 266, 268 and 270 in the pre-cut fibrous insulation blanket 220, are filled, e.g. with the bonding agent that bonds the facing sheet 250 to the major surface 232 of the faced pre-cut fibrous insulation blanket or a similar material, to close the perforations so that the facing sheet 250 functions as a vapor barrier. While perforations are preferred, tear strings could be used with or substituted for the perforated lines 266, 268 and 270. The tear strings would have a free end for gripping; be bonded to the facing by the bonding agent; and would extend along lines that coincide with the locations of the perforated lines 266, 268 and 270.

The use of pairs of tabs 260, 262 and 264 formed by Z-shaped pleats in the facing 250 wherein the tabs of each pair of tabs are separably bonded together by the bonding agent bonding the facing 250 to a major surface of the faced pre-cut fibrous insulation blanket provides several advantages: the overlapping and bonding together of the tabs across their widths in each pair of tabs with the perforations at the juncture of the tabs improves the vapor barrier properties of the perforated facing; there is less tendency for the facing 250 to split during installation because the bonding agent joining the tabs of each pair of tabs together can yield when the faced pre-cut fibrous insulation blanket is flexed; the folds at the perforations in the Z-shaped pleats facilitate the tearing of the facing 250 at the perforations and help prevent the tears from propagating out of the tabs; and, as shown in FIG. 34, as the blanket sections adjacent a pair of tabs are separated, the tabs which initially lie on a major surface of the blanket are pulled away from the major surface of the blanket to extend generally perpendicular to the major surface of the blanket for better grasping by a worker as the tabs peel away from each other and finally separate from each other along the perforated lines. In addition, the use of facing tabs adjacent the cuts and separable connectors between blanket sections, in this and other embodiments of the invention, not only provides tabs for securing the blanket sections in place, but also enables the facings to provide vapor barriers across the entire width of blanket sections even when the means for separating the facings along each of the cuts and separable connectors, e.g. perforated lines, are not properly aligned with each of the cuts and separable connectors.

The integral tabs adjacent each cut 260, 262 and 264 plus lateral tabs, such as the lateral tabs 258 shown in FIG. 32, can be used to secure the faced pre-cut fibrous insulation blanket 220 or blanket sections of the faced pre-cut fibrous insulation blanket 220 to framing members, by stapling or other conventional means, either as a unit or as one or more sections when one or more blanket sections are separated from the remainder of the faced pre-cut fibrous insulation blanket. Preferably, the tabs are about three eights of an inch to about one and one half inches in width. When securing the faced pre-cut fibrous insulation blanket 220 or one or more blanket sections of the faced pre-cut fibrous insulation blanket to framing members, the tabs adjacent the series of cuts and separable connectors and lateral tabs used to secure the blanket are at least partially unfolded and extended outward from the faced pre-cut fibrous insulation blanket or blanket sections of the faced pre-cut fibrous insulation blanket prior to stapling or otherwise securing the tabs to the framing members.

Figure 35:
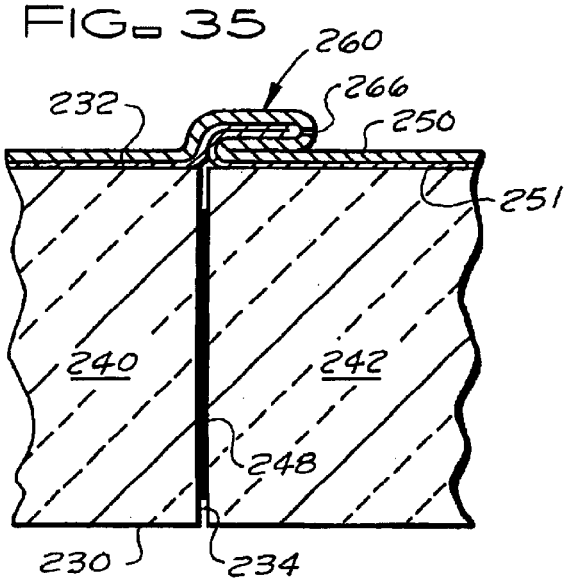
FIG. 35 is a partial schematic transverse cross section of a faced pre-cut fibrous insulation blanket of the present invention showing a separable adhesive connector that extends substantially from the first to the second major surface of the blanket and a facing sheet with an integral tab, formed by a Z-pleat, bonded to a major surface of the blanket and separable along the cut.

While the separable adhesive connectors 248 shown in FIGS. 32 to 34 joining the blanket sections 240, 242, 244 and 246 together are like the separable adhesive connectors 48 shown in FIGS. 3 to 5, it is to be understood that any of the separable adhesive connectors shown in FIGS. 3 to 23 may be used to separably join the blanket sections 240, 242, 244 and 246 of the pre-cut fibrous insulation blanket 220. Different applications may result in one form of separable adhesive connector being preferred over the other forms of separable adhesive connectors shown in FIGS. 3 to 23. For example, for certain applications it may be preferable to use separable adhesive connectors to join the blanket sections 240, 242 244 and 246 of the pre-cut fibrous insulation blanket 220 together such as the separable connector 248 shown in FIG. 35 which extends between or substantially between the major surfaces 230 and 232 of the pre-cut fibrous insulation blanket 220 and is like the separable adhesive connectors 48 shown in FIGS. 18 to 20.

Figure 36:
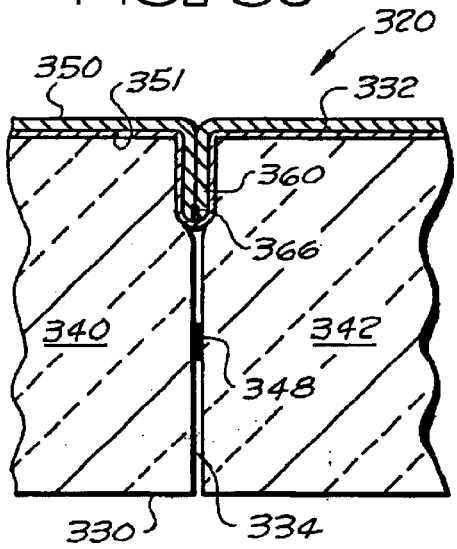
FIG. 36 is a partial schematic transverse cross section of a faced pre-cut fibrous insulation blanket of the present invention showing a separable adhesive connector between adjacent blanket sections and a facing sheet with integral tabs, formed by a pleat in the facing sheet inserted into the cut, bonded to a major surface of the blanket and separable along the cut in the blanket.

FIG. 36 is a partial transverse cross section of an embodiment 320 of the faced pre-cut fibrous insulation blanket of the present invention through one of the cuts 334 in the insulation blanket and a portion of a facing sheet 350 overlaying and bonded to the major surface 332 of the faced pre-cut fibrous insulation blanket by an adhesive layer or bonding agent 351. While the separable adhesive connector 348 shown in FIG. 33 joining the blanket sections 240 and 242 together is like the separable adhesive connectors 48 shown in FIGS. 3 to 5, it is to be understood that any of the separable adhesive connectors shown in FIGS. 3 to 23 may be used to separably join the blanket sections of the pre-cut fibrous insulation blanket 320.

Except for of a facing sheet with pairs of tabs inserted into the cuts dividing the pre-cut fibrous insulation blanket into sections rather than a facing sheet with tabs like the facing sheet 250 of the pre-cut fibrous insulation blanket 220, the pre-cut fibrous insulation blanket 320 is the same as the pre-cut fibrous insulation blanket 220 and may use any of the separable adhesive connectors shown in FIGS. 3 to 23. The facing sheet 350 is provided with a pair of tabs 360 adjacent and extending for the length of the cut 334 which are tucked into the cut. The tabs of the pair of tabs 360 are joined together along a perforated line 366 so that the tabs can be separated from each other along the cut 334 when the sections 340 and 342 are to be separated from each other. An identical pair of tabs are provided adjacent any additional cuts in the pre-cut fibrous insulation blanket which divide the pre-cut fibrous insulation blanket into additional sections.

With the separable adhesive connectors 348 and portions of the facing sheet 350 overlaying the cuts in the blanket forming separable connectors joining the adjacent blanket sections of the pre-cut fibrous insulation blanket 320 together, the pre-cut fibrous insulation blanket 320 can be handled as a unit for insulating a cavity having a predetermined width, such as but not limited to a thirteen inch width or a fourteen and one half or twenty two and one half standard cavity width, or easily separated by hand at one or more of the cuts in the blanket by separating or tearing apart the separable adhesive connectors 348 and the facing sheet 350 longitudinally along the cuts (separated without the need to use of a knife or other cutting tool) into one or more sections for insulating a cavity having a lesser width, such as less than a standard cavity width. The tabs on the facing sheet 350 enable the pre-cut fibrous insulation blanket 320 or sections of the pre-cut fibrous insulation blanket 320 to be easily secured to framing members.

Figure 37:
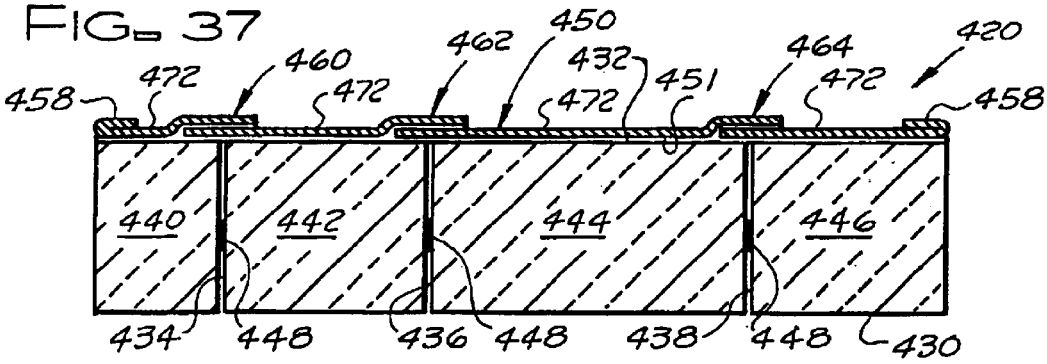
FIG. 37 is a schematic transverse cross section of a faced pre-cut fibrous insulation blanket of the present invention showing separable adhesive connectors joining adjacent blanket sections and a facing sheet with integral tabs, formed by overlapping lateral edge portions of a series of sheets forming the facing sheet, bonded to a major surface of the blanket and separable along the cuts in the blanket.
Figure 38:
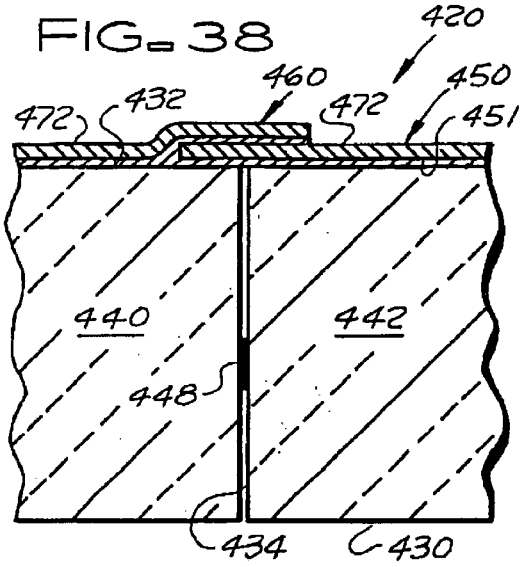
FIG. 38 is a partial schematic transverse cross section, on a larger scale than FIG. 37, of the faced pre-cut fibrous insulation blanket of FIG. 37.

FIGS. 37 and 38 show an embodiment 420 of the pre-cut fibrous insulation blanket of the present invention. There are one or more cuts, preferably two, three or more cuts (three cuts 434, 436 and 438 are shown) which extend from the first major surface 430 to the second major surface 432 of the pre-cut fibrous insulation blanket and for the length of the pre-cut fibrous insulation blanket 420. Each cut divides the pre-cut fibrous insulation blanket 420 into blanket sections with the pre-cut fibrous insulation blanket being divided lengthwise into two or more blanket sections and, preferably, three, four or more blanket sections (four blanket sections 440, 442, 444 and 446 are shown) extending the length of the pre-cut fibrous insulation blanket.

A facing sheet 450, preferably a water vapor impermeable facing sheet, is bonded to the second major surface 432 of the pre-cut fibrous insulation blanket by a bonding agent. The facing sheet 450 of the pre-cut fibrous insulation blanket 420 may be easily separated or torn apart by hand along the lengths of the cuts 434, 436 and/or 438. The bonding agent may be applied between the facing sheet 450 and the major surface 432 of the pre-cut fibrous insulation blanket 420 in the form of an adhesive layer 451 which is essentially coextensive with the major surfaces of the permeable sheet, the facing sheet and the pre-cut fibrous insulation blanket or in the form of continuous or dashed strips, dots, or other patterns covering less than the entire surface areas of the sheets and blanket (e.g. about 20% to a little less than 100% of the surface areas) provided the facing sheet 450 is bonded to the major surfaces of the pre-cut fibrous insulation blanket, preferably, along both sides of the each of the cuts in the blanket and along the lengths of each of the cuts in the blanket to hold the pre-cut fibrous insulation blanket 420 together for handling.

With the separable adhesive connectors 448 and the portions of the facing sheet 450, overlaying the cuts 434, 436 and 438, forming separable connectors joining the adjacent blanket sections 440, 442, 444 and 446 of the pre-cut fibrous insulation blanket 420 together, the pre-cut fibrous insulation blanket 420 can be handled as a unit for insulating a cavity having a predetermined width, such as but not limited to a thirteen inch width or a fourteen and one half or twenty two and one half standard cavity width, or easily separated by hand at one or more of the cuts 434, 436 and/or 438 by separating or tearing apart the separable adhesive connector 448 and the facing sheet 450 longitudinally along the cuts (separated without the need to use of a knife or other cutting tool) into one or more sections 440, 442, 444 and/or 446 for insulating a cavity having a lesser width, such as less than a standard cavity width.

The facing or facing sheet 450 is formed by the series of overlapping sheets 472. As shown in FIG. 34, the facing sheet 450 has lateral tabs 458 and pairs of tabs 460, 462 and 464, adjacent each cut in the faced pre-cut fibrous insulation blanket 420 for stapling or otherwise securing the faced pre-cut fibrous insulation blanket or section(s) of the faced pre-cut fibrous insulation blanket to frame members. The lateral tabs 458 extend for the length of the faced pre-cut fibrous insulation blanket 420. The pairs of tabs 460, 462 and 464 are aligned or substantially aligned longitudinally with and extend for the lengths of each cut 434, 436 and 438 in the faced pre-cut fibrous insulation blanket 420. Each pair of tabs 460, 462 and 464 is formed by a lateral edge portion of a preceding sheet 472 overlapping a lateral edge portion of a succeeding sheet 472 at each of the cuts 434, 436 and 438 in the faced pre-cut fibrous insulation blanket 420 with both lateral portions of the sheets extending laterally beyond the cuts in opposite directions as shown in FIGS. 37 and 38. The tabs of each pair of tabs 460, 462 and 464 are separably bonded together by the bonding agent bonding the facing sheet to the major surface 432 or a similar adhesive so that the facing can be separated at each of the cuts.

Preferably, the lateral edge portions of the sheets 472 forming the facing sheet 450 are bonded together e.g. with the bonding agent that bonds the facing sheet 450 to the major surface 432 of the pre-cut fibrous insulation blanket or a similar material, so that the facing sheet 450 functions as a vapor barrier. The pairs of tabs 460, 462 and 464 adjacent the cuts 434, 436 and 438 in the faced pre-cut fibrous insulation blanket 420 plus lateral tabs, such as the lateral tabs 458 shown in FIG. 37, can be used to secure the sections 440, 442, 444 and 446 of the faced pre-cut fibrous insulation blanket 420 to framing members, by stapling or other conventional means, either as a unit or as one or more sections when one or more sections 440, 442, 444 and 446 are separated from the remainder of the faced pre-cut fibrous insulation blanket. Preferably, each tab is about three eights of an inch to about one and one half inches wide. When securing the faced pre-cut fibrous insulation blanket 420 or one or more sections 440, 442, 444 and 446 of the faced pre-cut fibrous insulation blanket to framing members, the pairs tabs 460, 462 and 464 and lateral tabs 458 used to secure the blanket are extended outward from the faced pre-cut fibrous insulation blanket 420 or sections 440, 442, 444 and 446 of the faced pre-cut fibrous insulation blanket prior to stapling or otherwise securing the tabs to the framing members.

Figure 39:
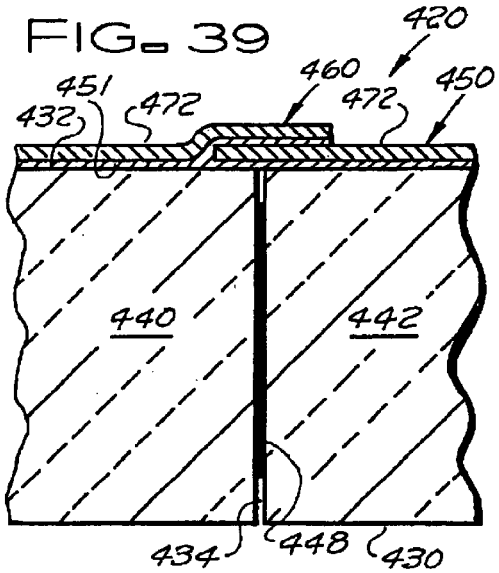
FIG. 39 is a partial schematic transverse cross section of a faced pre-cut fibrous insulation blanket of the present invention showing a separable adhesive connector that extends substantially from the first to the second major surface of the blanket and a facing sheet with integral tabs, formed by overlapping lateral edge portions of a series of sheets forming the facing sheet, bonded to a major surface of the blanket and separable along the cut.

While the separable adhesive connectors 448 shown in FIGS. 37 and 38 joining the blanket sections 440, 442, 444 and 446 together are like the separable adhesive connectors 48 shown in FIGS. 3 to 5, it is to be understood that any of the separable adhesive connectors shown in FIGS. 3 to 23 may be used to separably join the blanket sections 440, 442, 444 and 446 of the pre-cut fibrous insulation blanket 420. Different applications may result in one form of separable adhesive connector being preferred over the other forms of separable adhesive connectors shown in FIGS. 3 to 23. For example, for certain applications it may be preferable to use separable adhesive connectors to join the blanket sections 440, 442 444 and 446 of the pre-cut fibrous insulation blanket 420 together such as the separable connector 448 shown in FIG. 39 which extends between or substantially between the major surfaces 430 and 432 of the pre-cut fibrous insulation blanket 420 and is like the separable adhesive connectors 48 shown in FIGS. 18 to 20.

Figure 40:
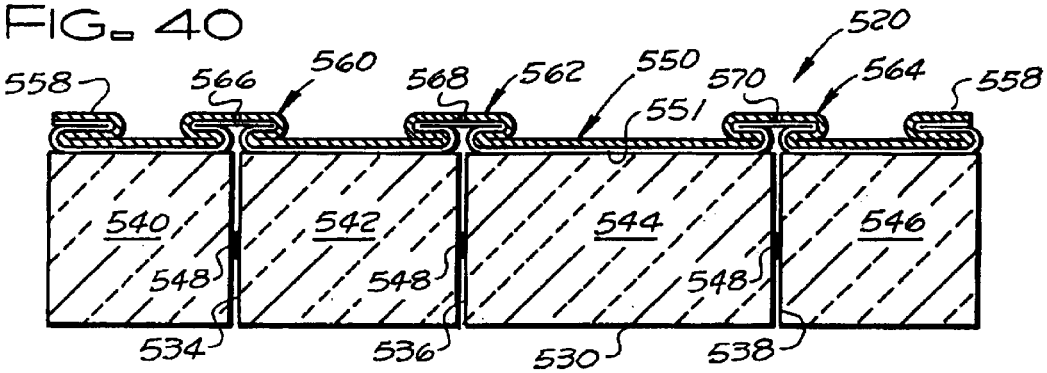
FIG. 40 is a schematic transverse cross section of a faced pre-cut fibrous insulation blanket of the present invention showing separable adhesive connectors joining adjacent blanket sections and a facing sheet with integral tabs in the facing sheet, formed by double Z-pleats, bonded to a major surface of the blanket and separable along the cuts in the blanket.
Figure 41:
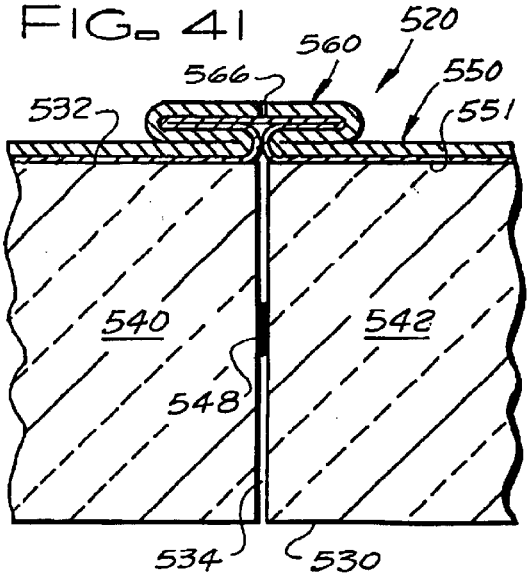
FIG. 41 is a partial schematic transverse cross section, on a larger scale than FIG. 40, of the faced pre-cut fibrous insulation blanket of FIG. 40.

FIGS. 40 and 41 show an embodiment 520 of the pre-cut fibrous insulation blanket of the present invention. There are one or more cuts, preferably two, three or more cuts (three cuts 534, 536 and 538 are shown) which extend from the first major surface 530 to the second major surface 532 of the pre-cut fibrous insulation blanket and for the length of the pre-cut fibrous insulation blanket 520. Each cut divides the pre-cut fibrous insulation blanket 520 into blanket sections with the pre-cut fibrous insulation blanket being divided lengthwise into two or more blanket sections and, preferably, three, four or more blanket sections (four blanket sections 540, 542, 544 and 546 are shown) extending the length of the pre-cut fibrous insulation blanket.

A facing sheet 550, preferably a water vapor impermeable facing sheet, is bonded to the second major surface 532 of the pre-cut fibrous insulation blanket by a bonding agent.

The facing sheet 550 of the pre-cut fibrous insulation blanket 520 may be easily separated or torn apart by hand along the lengths of the cuts 534, 536 and/or 538. The bonding agent may be applied between the facing sheet 550 and the major surface 532 of the pre-cut fibrous insulation blanket 520 in the form of an adhesive layer 551 which is essentially coextensive with the major surfaces of the facing sheet and the pre-cut fibrous insulation blanket or in the form of continuous or dashed strips, dots, or other patterns covering less than the entire surface areas of the sheets and blanket (e.g. about 20% to a little less than 100% of the surface areas) provided the facing sheet 550 is bonded to the major surface 532 of the pre-cut fibrous insulation blanket, preferably, along both sides of the each of the cuts in the blanket and along the lengths of each of the cuts in the blanket to hold the pre-cut fibrous insulation blanket 520 together for handling.

With the separable adhesive connectors 548 and the portions of the facing sheet 550 overlaying the cuts 534, 536 and 538 forming separable connectors joining the adjacent blanket sections 540, 542, 544 and 546 of the pre-cut fibrous insulation blanket 520 together, the pre-cut fibrous insulation blanket 520 can be handled as a unit for insulating a cavity having a predetermined width, such as but not limited to a thirteen inch width or a fourteen and one half or twenty two and one half standard cavity width, or easily separated by hand at one or more of the cuts 534, 536 and/or 538 by separating or tearing apart the separable adhesive connector 548 and the facing sheet 550 longitudinally along the cuts (separated without the need to use of a knife or other cutting tool) into one or more sections 540, 542, 544 and/or 546 for insulating a cavity having a lesser width, such as less than a standard cavity width.

As shown in FIG. 40, the facing sheet 550 has lateral tabs 558 and pairs of tabs 560, 562 and 564 adjacent each of the cuts 534, 536 and 538 in the faced pre-cut fibrous insulation blanket 520 for stapling or otherwise securing the faced pre-cut fibrous insulation blanket or section(s) of the faced pre-cut fibrous insulation blanket to frame members. The lateral tabs 558, which preferably are formed by Z-shaped pleats in the facing 550, extend for the length of the faced pre-cut fibrous insulation blanket 520 and the pairs of tabs 560, 562 and 564 are longitudinally aligned with and extend for the lengths of the cuts 534, 536 and 538 of the faced pre-cut fibrous insulation blanket 520. The pairs of tabs 560, 562 and 564 are each formed by a double Z-shaped pleat in the facing 550 with the tabs of each pair of tabs being joined together along lines of weakness such as perforated lines 566, 568 and 570 in the facing that are aligned with the cuts 534, 536 and 538 so that the tabs of each pair of tabs can be separated from each other at the cuts when the blanket sections 540, 542, 544 and/or 546 are separated from each other. Each tab is formed by twice folding the facing sheet 550 back upon itself into a Z-shaped pleat.

The spaced apart perforations of the perforated lines 566, 568 and 570 may be of various shapes, including but not limited to, round, oval, elongated, slit shaped, etc., and the spacing between perforations and the length of the perforations may vary as long as the facing is easily separated by hand along the line(s) formed by the perforations. Preferably, the perforations of perforated lines in the facing 550 of the faced pre-cut fibrous insulation blanket 520 are filled, e.g. with the bonding agent that bonds the facing sheet 550 to a major surface of the pre-cut fibrous insulation blanket or a similar material, to close the perforations so that the facing sheet 550 functions as a vapor barrier. While perforations are preferred, tear strings could be used with or substituted for the perforated lines 566, 568 and 570. The tear strings would have a free end for gripping; be bonded to the facing by the bonding agent; and would extend along lines that coincide with the locations of the perforated lines 566, 568 and 570.

The integral pairs of tabs 560, 562 and 564 adjacent each series of cuts and separable connectors plus lateral tabs, such as the lateral tabs 558 shown in FIG. 40, can be used to secure the faced pre-cut fibrous insulation blanket 520 or blanket sections of the faced pre-cut fibrous insulation blanket 520 to framing members, by stapling or other conventional means, either as a unit or as one or more sections when one or more blanket sections are separated from the remainder of the faced pre-cut fibrous insulation blanket. Preferably, the tabs are about three eights of an inch to about one and one half inches in width. When securing the faced pre-cut fibrous insulation blanket 520 or one or more blanket sections of the faced pre-cut fibrous insulation blanket to framing members, the tabs adjacent the series of cuts and separable connectors and lateral tabs used to secure the blanket are at least partially unfolded and extended outward from the faced pre-cut fibrous insulation blanket or blanket sections of the faced pre-cut fibrous insulation blanket prior to stapling or otherwise securing the tabs to the framing members.

Figure 42:
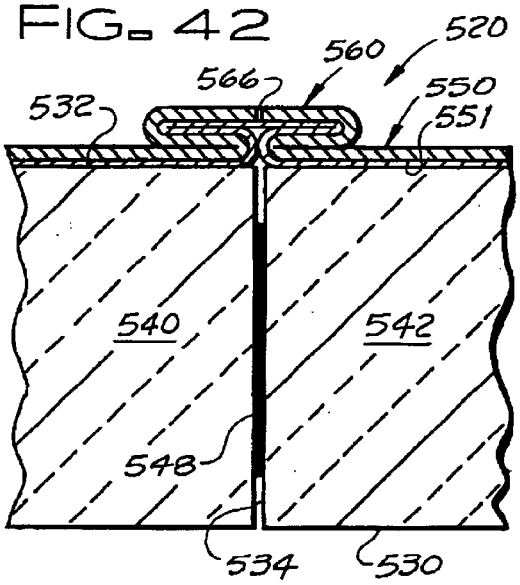
FIG. 42 is a partial schematic transverse cross section of a faced pre-cut fibrous insulation blanket of the present invention showing a separable adhesive connector that extends substantially from the first to the second major surface of the blanket and a facing sheet with integral tabs in the facing sheet, formed by double Z-pleats, bonded to a major surface of the blanket and separable along the cut in the blanket.

While the separable adhesive connectors 548 shown in FIGS. 40 and 41 joining the blanket sections 540, 542, 544 and 546 together are like the separable adhesive connectors 48 shown in FIGS. 3 to 5, it is to be understood that any of the separable adhesive connectors shown in FIGS. 3 to 23 may be used to separably join the blanket sections 540, 542, 544 and 546 of the pre-cut fibrous insulation blanket 520. Different applications may result in one form of separable adhesive connector being preferred over the other forms of separable adhesive connectors shown in FIGS. 3 to 23. For example, for certain applications it may be preferable to use separable adhesive connectors to join the blanket sections 540, 542 544 and 546 of the pre-cut fibrous insulation blanket 520 together such as the separable connector 548 shown in FIG. 42 which extends between or substantially between the major surfaces 530 and 532 of the pre-cut fibrous insulation blanket 520 and is like the separable adhesive connectors 48 shown in FIGS. 18 to 20.

FIG. 43 is a partial transverse cross section of an embodiment 620 of the faced pre-cut fibrous insulation blanket of the present invention through one of the cuts 634 in the insulation blanket and a portion of the facing 650 overlaying and bonded to the major surface 632 of the faced pre-cut fibrous insulation blanket 620 by an adhesive layer 651. Except for the structure of the tabs and facing sheet adjacent each of the cuts in the blanket, the faced pre-cut fibrous insulation blanket 620 of FIG. 43 is the same as the faced pre-cut insulation blanket 520 of FIGS. 40 and 41 and may use any of the separable adhesive connectors shown in FIGS. 3 to 23 to separably hold adjacent sections of the blanket together. As shown, the facing 650 is provided with a cut or perforated line 666. The perforated line 666 is aligned with and extends for the length of the cut 634 so that the facing 650 can be separated at the cut. A separate sheet of facing material 674 is bonded by a bonding agent 676 to the facing 650 on either side of the perforated line 666 and extends for the length of the perforated line. The sheet 674 has a pair of tabs 660 adjacent and extending for the length of the cut 634 in the pre-cut fibrous insulation blanket. The pair of tabs 660 are formed by a double Z-shaped pleat in the facing material 674 with the tabs 660 being joined together along a perforated line 678 that is aligned with the cut 634 so that the tabs can be separated from each other at the cut 634 when the blanket sections 640 and 642 are separated from each other. Each tab of the pair of tabs 660 is formed by twice folding the sheet 674 of facing material back upon itself into a Z-shaped pleat, and identical pairs of integral tabs are located adjacent and extend for the length of the each additional cut in the faced pre-cut fibrous insulation blanket 620, dividing blanket sections of the faced pre-cut fibrous insulation blanket. With this structure, the faced pre-cut fibrous insulation blanket 620 can be handled as a unit for insulating a cavity having a predetermined cavity width, such as but not limited to a thirteen inch width or a fourteen and one half or twenty two and one half inch standard cavity width, or easily separated or torn apart by hand into one or more blanket sections by separating or tearing apart the separable adhesive connector 648 and the facing sheet of the pre-cut fibrous insulation blanket 620 at any one or more of the cuts (separated without the need to use of a knife or other cutting tool) for insulating a cavity having lesser width, e.g. less than a standard cavity width.

The spaced apart perforations of the perforated lines in the facing sheet 620 and the sheet 674 may be of various shapes, including but not limited to, round, oval, elongated, slit shaped, etc., and the spacing between perforations and the length of the perforations may vary as long as the facing is easily separated by hand along the line(s) formed by the perforations. Preferably, the perforations of perforated lines in the facing and between the tabs adjacent each cut in the faced pre-cut fibrous insulation blanket 620 are filled, e.g. with the bonding agents that bond the facing sheet 650 to a major surface of the pre-cut fibrous insulation blanket and the sheet of facing material 674 to the facing sheet 650 or a similar material, to close the perforations so that the facing sheet 650 functions as a vapor barrier. While perforations are preferred as the separable means for the tabs, tear strings could be used with or substituted for the perforated lines. The tear strings would have a free end for gripping; be bonded to the facing by the bonding agent; and would extend along lines that coincide with the locations of the perforated lines normally used as the separable means for the tabs.

The tabs adjacent each cut plus lateral tabs, such as the lateral tabs 558 shown in FIG. 40, can be used to secure the faced pre-cut fibrous insulation blanket 620 or blanket sections of the faced pre-cut fibrous insulation blanket 620 to framing members, by stapling or other conventional means, either as a unit or as one or more blanket sections when one or more blanket sections are separated from the remainder of the faced pre-cut fibrous insulation blanket. Preferably, the tabs are about three eights of an inch to about one and one half inches in width. When securing the faced pre-cut fibrous insulation blanket 620 or one or more blanket sections of the faced pre-cut fibrous insulation blanket to framing members, the tabs adjacent the series of cuts and separable connectors and lateral tabs used to secure the blanket are at least partially unfolded and extended outward from the faced pre-cut fibrous insulation blanket or blanket sections of the faced pre-cut fibrous insulation blanket prior to stapling or otherwise securing the tabs to the framing members.

As an example of the versatility of the unfaced and faced pre-cut fibrous insulation blankets 20 to 620, the preferred different widths of the sections, when four sections are formed in a fifteen inch wide embodiment of the invention, enable the pre-cut fibrous insulation blankets 20 to 620 to be quickly and easily formed into widths of about three and one-half inches (e.g. section 40), about four and one half inches (e.g. section 42), about five and one-half inches (e.g. section 44), one and one-half inches (section 46), about eight inches (e.g. sections 40 and 42), about thirteen and one half inches (sections 40, 42 and 44) and eleven and one-half inches (e.g. sections 42, 44 and 46). Thus, the pre-cut fibrous insulation blankets 20 to 620 can not only be used to insulate cavities having standard widths, but the width of the pre-cut fibrous insulation blanket can also be quickly and easily modified to fit cavities of various non-standard widths. The use of a resilient fibrous insulation blanket 20 to 620, such as a resilient glass fiber insulation blanket, further enhances the ability of the pre-cut fibrous insulation blanket to conform to various cavity widths.

FIGS. 44 to 46 schematically show one preferred apparatus and method for making the unfaced pre-cut fibrous insulation blanket 20 and the faced pre-cut fibrous insulation blankets 120 to 620 of the present invention. With this preferred apparatus and method a fibrous insulation blanket, typically a glass fiber insulation blanket about eight to about ten feet wide and cut longitudinally into a series of five or more blankets 20 (e.g. individual blankets being about thirteen, fifteen or twenty three inches wide, only one of which is shown for the purposed of illustration), is fed through a cutting station 700, an adhesive application station 702, and a facing station 704. From the facing station 704, the unfaced or faced pre-cut fibrous insulation blankets 20 to 620 are fed to a windup station (not shown) where the pre-cut fibrous insulation blankets are wound up for packaging and shipment or are fed through a conventional chopper and into a conventional batt packing station (not shown) where the batts are stacked and packaged for shipment.

The cutting station 700 may utilize a series of rotary saws 706, water jet slitters (not shown) or other cutting equipment to form cuts 34, 36 and 38 in the fibrous insulation blanket and cut the fibrous insulation blanket 20 into sections, e.g. sections 40, 42, 44 and 46. The rotary saws 706, water jet slitters, or other cutting equipment are spaced apart from each other across the width of the cutting station 700 at locations to form blanket sections of the desired width.

Each fibrous insulation blanket 20, now cut into sections 40, 42, 44 and 46, then passes through the adhesive application station 702 where adhesive is applied intermediate the opposed surfaces of adjacent blanket sections 40, 42, 44 and 46 formed by cuts 34, 36 and 38 to form separable connectors 48 of the type shown in FIGS. 3 to 23. The adhesive application station is provided with a series of adhesive applicators, such as but not limited to the adhesive applicator 708 shown in FIG. 46, with one adhesive applicator 708 being located within each of the cuts 34, 36 and 38. Each adhesive applicator 708 has vertically extending upstream edge 710 and vertically extending side surfaces 712 which extend laterally outward, in the downstream direction, from the upstream edge 710 to penetrate the cut and separate the opposed surfaces of adjacent blanket sections to permit the application of adhesive to one or both of these opposed surfaces. At or adjacent a downstream end 714 of the adhesive applicator 708, the adhesive applicator 708 is provided with one or more outlet orifices or spray nozzles 716 (three of which are shown on one sidewall of the adhesive applicator) on one or both sidewalls or on the end wall 714 of the adhesive applicator to dispense adhesive onto the one or both opposed surfaces of the adjacent blanket sections 40, 42, 44 and 46. The adhesive is supplied to the orifices or spray nozzles under pressure and may be selectively supplied to any one, any two, or all of the orifices on either or both side of the adhesive applicator 708. After the blanket 20 passes through the adhesive applicator station 702, the resilience of the blanket sections 40, 42, 44 and 46 brings the opposed surfaces of adjacent blanket sections back into contact with each other and the adhesive applied between the opposed surfaces of adjacent blanket sections forms separable connector(s) joining the adjacent blanket sections.

When the fibrous insulation blankets 20 are to be faced, each pre-cut fibrous insulation blanket 20 is fed through the facing station 704 where, as shown, a facing sheet, such as one of the facing sheets 150 to 650, is applied and bonded to the underside of the pre-cut fibrous insulation blanket 20. The facing sheet, to be applied to the fibrous insulation blanket 20, has one or more pairs of tabs joined by longitudinally extending perforated lines, and lateral tabs which extend for the length of the facing sheet such as facing sheets 150, 250, 450, 550 and 650. The facing sheet which may have its tabs pre-formed, the perforations in its perforated lines filled with bonding agent, and be coated with a bonding agent on the major surface to be applied to the pre-cut fibrous insulation blanket, is fed from a supply roll 718. Where the bonding agent is an asphalt or another bituminous material, the facing sheet 150 to 650 is passed through a heater station 720 to heat the bonding agent. As shown, the facing sheet is then applied to underside or lower major surface of the pre-cut fibrous insulation blanket 20, while the bonding agent is still hot, with the pairs of tabs joined by the perforated lines in the facing sheet longitudinally aligned with the cuts, e.g. cuts 34, 36 and 38, in the pre-cut fibrous insulation blanket 20 and the facing sheet is bonded to the blanket to form the pre-cut fibrous insulation blanket 120, 220, 320, 520 or 620. Where a pressure sensitive adhesive is used to bond the facing sheet 150, 250, 350, 550 or 650 to the pre-cut fibrous insulation blanket 20, the preformed facing sheet with pressure sensitive adhesive on one major surface is fed from the supply roll 718 and the major surface of the facing sheet with the bonding agent thereon is then brought into contact with, pressed against and bonded to the underside or lower major surface of the pre-cut fibrous insulation blanket 20 with the pairs of tabs joined by the perforated lines in the facing sheet longitudinally aligned with the cuts, e.g. cuts 34, 36 and 38, in the pre-cut fibrous insulation blanket 20.

When the facing 450 is applied to each fibrous insulation blanket 20, the facing has one or more longitudinally extending pairs of overlapping tabs which are adhesively bonded together, plus lateral tabs extending for the length of the facing sheet. The facing sheet 450, which may have its tabs pre-formed, and be coated with a bonding agent on the major surface to be applied to the pre-cut fibrous insulation blanket, is fed from the supply roll 718. Where the bonding agent is an asphalt or another bituminous material, the facing sheet 450 is passed through a heater station 720 to heat the bonding agent. The facing sheet is then applied to underside or lower major surface of the pre-cut fibrous insulation blanket 20, while the bonding agent is still hot, with the pairs of tabs in the facing sheet longitudinally aligned with the cuts, e.g. cuts 34, 36 and 38, in the pre-cut fibrous insulation blanket 20 and the facing sheet is bonded to the blanket to form the pre-cut fibrous insulation blanket 420. Where a pressure sensitive adhesive is used to bond the facing sheet 450 to the pre-cut fibrous insulation blanket 20, the preformed facing sheet with pressure sensitive adhesive on one major surface is fed from the supply roll 718 and the major surface of the facing sheet with the bonding agent thereon is then brought into contact with, pressed against and bonded to the underside or lower major surface of the pre-cut fibrous insulation blanket 20 with the pairs of tabs in the facing sheet longitudinally aligned with the cuts, e.g. cuts 34, 36 and 38, in the pre-cut fibrous insulation blanket 20.

While in the method described above, the facing sheets 150 to 650 are pre-formed and pre-coated with a bonding agent and fed from a supply roll 718, the facing sheets 150 to 650 may also be formed on line and thereafter applied directly to the pre-cut fibrous insulation blanket 20. In addition, while the facing is shown being applied to the underside of the insulation blanket, the facing could be applied to the upper surface of the insulation blanket. Also, the adhesive bonding the facing to the blanket could be applied to the surface of the blanket being faced rather than to the facing. With the facing sheets 150 to 650, the faced pre-cut fibrous insulation blanket formed can be handled as a unit or easily torn apart at one or more of the cuts 34, 36 and 38 in the blanket and the perforated lines joining the tabs in the facing by hand (without the need to use of a knife or other cutting tool) for insulating a cavity of lesser width than the faced pre-cut fibrous insulation blanket. After passing through the facing station 704, the pre-cut faced fibrous insulation blanket 120 to 620 is then formed into a roll in the windup station or cut transversely into selected lengths to form batts (not shown), e.g. forty eight or ninety three inch length batts, which are stacked and packaged.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A building material, comprising:

fibrous insulation having a length, a width, and a depth, wherein the length and the width define first and second major surfaces separated by the depth, the fibrous insulation having at least one cut extending from the first major surface, through the depth, to the second major surface, said cut extending along at least a portion of the length of the fibrous insulation so as to divide the fibrous insulation into a plurality of fibrous insulation strips, wherein the fibrous insulation strips are removably secured across the at least one cut by an adhesive material such that the fibrous insulation may be separated by hand into strips for installation into a cavity.

2. The building material of claim 1, wherein at least one of the fibrous insulation strips has a width of about four inches.

3. The building material of claim 1, wherein at least one of the fibrous insulation strips has a width of about three inches.

4. The building material of claim 1, wherein at least one of the fibrous insulation strips has a width of about two-and-one-half inches.

5. The building material of claim 1, wherein at least one of the fibrous insulation strips has a width of about four-and-one-half inches.

6. The building material of claim 1, wherein at least one of the fibrous insulation strips has a width of about five inches.

7. The building material of claim 1, wherein the width of the fibrous insulation is about fifteen inches.

8. The building material of claim 1, wherein the width of the fibrous insulation is about twenty-three inches.

9. The building material of claim 1, further comprising a vapor barrier facing sheet bonded to the first major surface, wherein the facing sheet comprises at least one separable connector aligned with the at least one cut.

10. The building material of claim 1, wherein the building material has three cuts that divide the fibrous insulation into four fibrous insulation strips that are each removably secured across at least one of the three cuts by an adhesive material to another of the four fibrous insulation strips such that the fibrous insulation may be separated by hand into strips for installation into a cavity.

11. The building material of claim 10, wherein at least two of the fibrous insulation strips have a different width.

12. The building material of claim 10, wherein one of the strips has a width of about 2.5 inches, one of the strips has a width of about 4 inches, and one of the strips has a width of about 4.5 inches.

13. The building material of claim 10, wherein one of the strips has a width of about 11.5 inches, one of the strips has a width of about 4 inches, and one of the strips has a width of about 3.5 inches.

14. A fibrous insulation assembly having a length, a width, and a depth, wherein the length and the width define first and second major surfaces separated by the depth, the fibrous insulation assembly comprising:

at least one cut extending from the first major surface, through the depth, to the second major surface, said cut extending along at least a portion of the length of the fibrous insulation assembly so as to divide the fibrous insulation into a plurality of fibrous insulation strips; and discontinuous adhesive strip means for removably securing each of the fibrous insulation strips to at least one other of the fibrous insulation strips across the at least one cut such that the fibrous insulation assembly may be separated by hand into strips for installation into a cavity.

15. The fibrous insulation assembly of claim 14, further comprising a vapor barrier facing sheet bonded to the first major surface, wherein the facing sheet comprises at least one separable connector aligned with the at least one cut.

16. The fibrous insulation assembly of claim 14, wherein at least one of the fibrous insulation strips has a width of about four inches.

17. The fibrous insulation assembly of claim 14, wherein at least one of the fibrous insulation strips has a width of about three inches.

18. The fibrous insulation assembly of claim 14, wherein at least one of the fibrous insulation strips has a width of about two-and-one-half inches.

19. The fibrous insulation assembly of claim 14, wherein at least one of the fibrous insulation strips has a width of about four-and-one-half inches.

20. The fibrous insulation assembly of claim 14, wherein at least one of the fibrous insulation strips has a width of about five inches.

21. The fibrous insulation assembly of claim 14, wherein the width of the fibrous insulation assembly is about fifteen inches.

22. The fibrous insulation assembly of claim 14, wherein the width of the fibrous insulation assembly is about twenty-three inches.

23. The fibrous insulation assembly of claim 14, wherein the fibrous insulation assembly has three cuts that divide the fibrous insulation assembly into four fibrous insulation strips that are each removably secured across at least one of the three cuts by the discontinuous adhesive strip means to another of the four fibrous insulation strips such that the fibrous insulation may be separated by hand into strips for installation into a cavity.

24. The fibrous insulation assembly of claim 23, wherein at least two of the fibrous insulation strips have a different width.

* * * * *